US007934857B2

(12) United States Patent
Kukita

(10) Patent No.: US 7,934,857 B2
(45) Date of Patent: May 3, 2011

(54) ILLUMINATING DEVICE AND GAMING MACHINE HAVING THE SAME

(75) Inventor: Noritoshi Kukita, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 323 days.

(21) Appl. No.: 12/207,941

(22) Filed: Sep. 10, 2008

(65) Prior Publication Data

US 2010/0020546 A1 Jan. 28, 2010

Related U.S. Application Data

(60) Provisional application No. 61/082,617, filed on Jul. 22, 2008.

(51) Int. Cl.
*F21V 8/00* (2006.01)

(52) U.S. Cl. ..... 362/307; 362/231; 362/607; 362/616; 362/806; 362/565

(58) Field of Classification Search ..... 362/307, 362/231, 607, 610, 616, 560, 806, 565; 463/20
See application file for complete search history.

(56) References Cited

U.S. PATENT DOCUMENTS 7,331,694 B2 * 2/2008 Lee et al. ..... 362/335

FOREIGN PATENT DOCUMENTS

JP 0432203 A * 11/1992
WO WO99/03078 1/1999

* cited by examiner

*Primary Examiner* — Sharon E Payne
(74) *Attorney, Agent, or Firm* — NDQ&M Watchstone LLP

(57) ABSTRACT

An illuminating device includes: an illuminating board having a plate-like transparent board, a reflector provided on a back surface of the transparent board to reflect light, and a cloudy, translucent medium provided on a front surface of the transparent board; a support member supporting an end of the illuminating board in a cantilever fashion, so as to provide a free end for the other end of the illuminating board; a light emitting portion, arranged beside the supported end of the illuminating board, that emits light to the transparent board at the supported end; and an emission control unit that causes the light emitting portion to emit light.

5 Claims, 15 Drawing Sheets

FIG. 8

| | DISPLAY WINDOW151 | DISPLAY WINDOW152 | DISPLAY WINDOW153 | DISPLAY WINDOW154 | DISPLAY WINDOW155 |
|---|---|---|---|---|---|
| CODE NO. | SYMBOL | SYMBOL | SYMBOL | SYMBOL | SYMBOL |
| 00 | Angelfish | Tuna | Tuna | Coelacanth | Clownfish |
| 01 | Clownfish | Coelacanth | Tuna | Angelfish | Tuna |
| 02 | Angelfish | Tuna | Angelfish | Clownfish | Angelfish |
| 03 | Clownfish | Coelacanth | Tuna | BONUS | Coelacanth |
| 04 | Angelfish | Tuna | Angelfish | Coelacanth | Clownfish |
| 05 | Clownfish | Angelfish | Clownfish | Clownfish | 7 |
| 06 | Angelfish | Clownfish | Angelfish | Tuna | Angelfish |
| 07 | Clownfish | Tuna | Clownfish | 7 | Tuna |
| 08 | 7 | Coelacanth | Angelfish | Clownfish | Clownfish |
| 09 | Tuna | Tuna | Clownfish | Angelfish | Coelacanth |
| 10 | Angelfish | Coelacanth | Angelfish | Coelacanth | Tuna |
| 11 | Coelacanth | BONUS | Clownfish | Angelfish | Clownfish |
| 12 | Angelfish | Clownfish | Coelacanth | Clownfish | Coelacanth |
| 13 | BONUS | 7 | BONUS | Tuna | Angelfish |
| 14 | 7 | Coelacanth | 7 | Tuna | Tuna |
| 15 | Angelfish | Tuna | Coelacanth | BONUS | Clownfish |
| 16 | Tuna | Coelacanth | Tuna | Tuna | Tuna |
| 17 | Clownfish | BONUS | Clownfish | Coelacanth | Angelfish |
| 18 | Angelfish | Clownfish | Angelfish | Clownfish | Coelacanth |
| 19 | Clownfish | Tuna | Clownfish | Angelfish | Angelfish |
| 20 | 7 | Coelacanth | Angelfish | Tuna | Clownfish |
| 21 | Tuna | Tuna | Clownfish | Clownfish | BONUS |

FIG. 9

PATH TABLE

| PATH | NUMBER OF LIGHT EMITTING PORTIONS |
|---|---|
| PATH 401a | 100 |
| PATH 401b | 110 |
| PATH 401c | 120 |
| ..... | ..... |
| PATH 401j | 100 |

FIG. 10

PATH ACTIVATION STATE TABLE

| PATH | NUMBERS ACTIVATED | NUMBERS YET TO BE ACTIVATED | NUMBER OF WINNINGS | REMAINING NUMBER OF WINNINGS |
|---|---|---|---|---|
| PATH 401a | 10 | 90 | 1 | 4 |
| PATH 401b | 0 | 110 | 0 | 5 |
| PATH 401c | 100 | 20 | 4 | 1 |
| ..... | ..... | ..... | ..... | ..... |
| PATH 401j | 30 | 70 | 1 | 4 |

ILLUMINATING DEVICE AND GAMING MACHINE HAVING THE SAME

CROSS REFERENCE TO RELATED APPLICATION

The present application claims priority from U.S. Provisional Patent Application No. 61/082,617, which was filed on Jul. 22, 2008, the disclosure of which is herein incorporated by reference in its entirety.

BACKGROUND OF THE INVENTION

1. Field of the Invention

The present invention relates to an illuminating device and a gaming machine.

2. Description of Related Art

Conventional gaming machines include: an illuminating unit provided with light emitting portions; control panels provided to accept players' operations; and a game controller, which, in performing a multiplayer game, changes a state of the game according to the operations accepted by the control panels and causes the illuminating unit to emit light according to the state change of the game. Such a conventional gaming machine is disclosed, for example, in International Publication WO99/03078. Preferably, the illuminating unit used for such gaming machines should be designed to provide the largest possible dimensions, in order to improve viewability for the players.

However, since the light appears brighter in areas closer to the light emitting portions and darker in areas farther from the light emitting portions, the brightness varies and uniform emission in the illuminating unit becomes progressively difficult as the dimensions of the illuminating unit are increased. There is also a demand to provide a free space around the illuminating unit, to make the designing of the illuminating unit easier.

It is accordingly an object of the present invention to provide an illuminating device that can produce apparently uniform emission throughout the illuminating unit despite the large dimensions of the illuminating unit. The invention also provides a gaming machine having such an illuminating device.

SUMMARY OF THE INVENTION

In order to achieve the foregoing object, an illuminating device according to an aspect of the present invention includes:

an illuminating board having a plate-like transparent board, a reflector provided on a back surface of the transparent board to reflect light, and a cloudy, translucent medium provided on a front surface of the transparent board;

a support member to support one end of the illuminating board in a cantilever fashion to provide a free end for the other end of the illuminating board;

a light emitting portion, arranged beside the supported end of the illuminating board, that emits light to the transparent board at the supported end; and an emission control unit that causes the light emitting portion to emit light.

With this structure, the light incident on the transparent board is reflected by the reflector to travel toward portions of the transparent board farther from the light emitting portion. The light incident on the transparent board travels through the cloudy, translucent medium toward the front side of the illuminating board. There accordingly will be no nonuniformity of brightness, where the transparent board appears brighter in portions closer to the light emitting portion and darker in portions farther away from the light emitting portion. The illuminating board appears as though it is uniformly emitting light. Further, by the cantilever arrangement of the illuminating board, a free space can be provided at the free end and beneath the illuminating board.

A demand for uniform emission at the rim of the housing can be effectively met when the illuminating device is structured to include: a housing having a base, and peripheral walls provided along the rim of the base;

a set of illuminating boards forming a loop as viewed from the front, the illuminating boards each having a plate-like transparent board, a reflector provided on a back surface of the transparent board to reflect light, and a cloudy, translucent medium provided on a front surface of the transparent board;

a support member supporting an end of each illuminating board in a cantilever fashion, so as to provide a free end for the other end of the illuminating board, the illuminating boards being adjacent to the peripheral walls as viewed from the front;

a light emitting portion, arranged beside the supported end of each illuminating board, that emits light to the transparent board at the supported end; and an emission control unit that causes the light emitting portion to emit light.

The illuminating device can have a solid-look as viewed from the side when it is structured to preferably include:

a housing having a base, and peripheral walls provided along a rim of the base;

plural sets of illuminating boards forming a loop as viewed from front, the illuminating boards each having a plate-like transparent board, a reflector provided on a back surface of the transparent board to reflect light, and a cloudy, translucent medium provided on a front surface of the transparent board;

a support member, provided for each illuminating board, supporting an end of the illuminating board in a cantilever fashion, so as to provide a free end for the other end of the illuminating board;

a light emitting portion, arranged beside the supported end of each illuminating board, that emits light to the transparent board at the supported end; and an emission control unit that causes the light emitting portion to emit light, wherein the peripheral walls and the sets of illuminating boards are arranged adjacent to one another in this order as viewed from front, and wherein the sets of illuminating boards are arranged at different distances from the base.

In order for the illuminating device to produce a wide variety of attractive, different colors, it is preferable that the light emitting portion be capable of emitting light in multiple colors, and that the emission control unit cause the light emitting portions to emit light in different colors.

An illuminating device according to the present invention, with the structure described above, can be suitably used for a gaming machine including: (I) an illuminating unit that includes: an illuminating board having a plate-like transparent board, a reflector provided on a back surface of the transparent board to reflect light, and a cloudy, translucent medium provided on a front surface of the transparent board; a support member supporting an end of the illuminating board in a cantilever fashion, so as to provide a free end for the other end of the illuminating board; a light emitting portion, arranged beside the supported end of the illuminating board, that emits light to the transparent board at the supported end; and an emission control unit that causes the light emitting portion to emit light; (II) a plurality of control panels that accepts a player's operation; and (III) a game controller programmed to perform the steps of:

(a1) performing a multiplayer game;

(a2) causing the control panels to accept a player's operation;

(a3) changing a state of the game according to the operation accepted by the control panels; and (a4) causing the illuminating unit to emit light according to the state of the game.

BRIEF DESCRIPTION OF THE DRAWINGS

FIG. 8 is an explanatory diagram illustrating a symbol column of symbols rearranged on a terminal display.

FIG. 9 is a diagram showing a path table.

FIG. 10 is a diagram showing a path activation state table.

DESCRIPTION OF THE PREFERRED EMBODIMENTS

Figure 1:
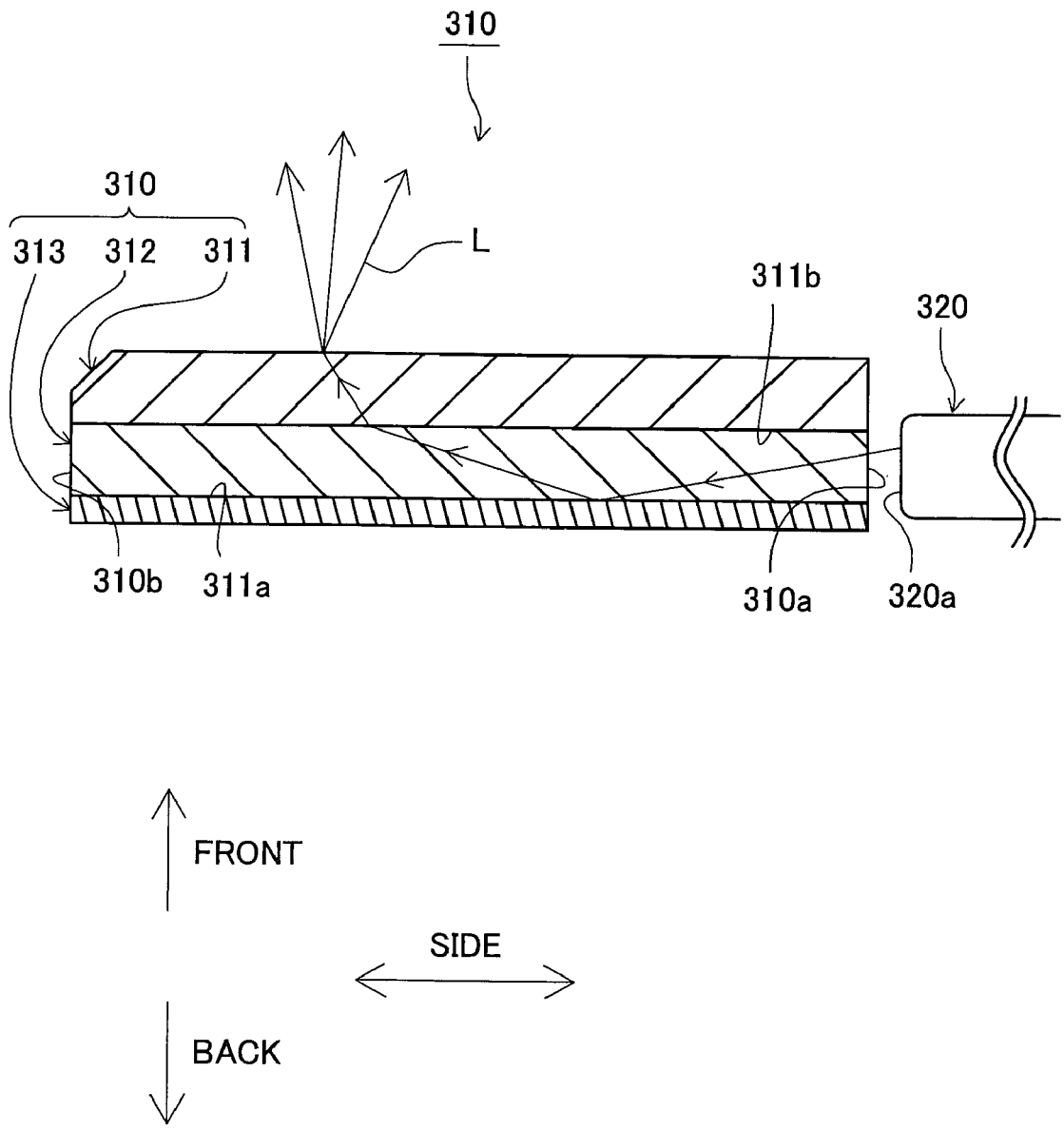
FIG. 1 is a longitudinal sectional view of an illuminating board of an illuminating device according to one embodiment of the present invention.

The following will describe an embodiment of an illuminating device according to the present invention, with reference to FIG. 1 through FIG. 4.

An illuminating device 300 includes a housing 301, illuminating boards 310, support members 330, and light emitting portions 320.

Figure 2:
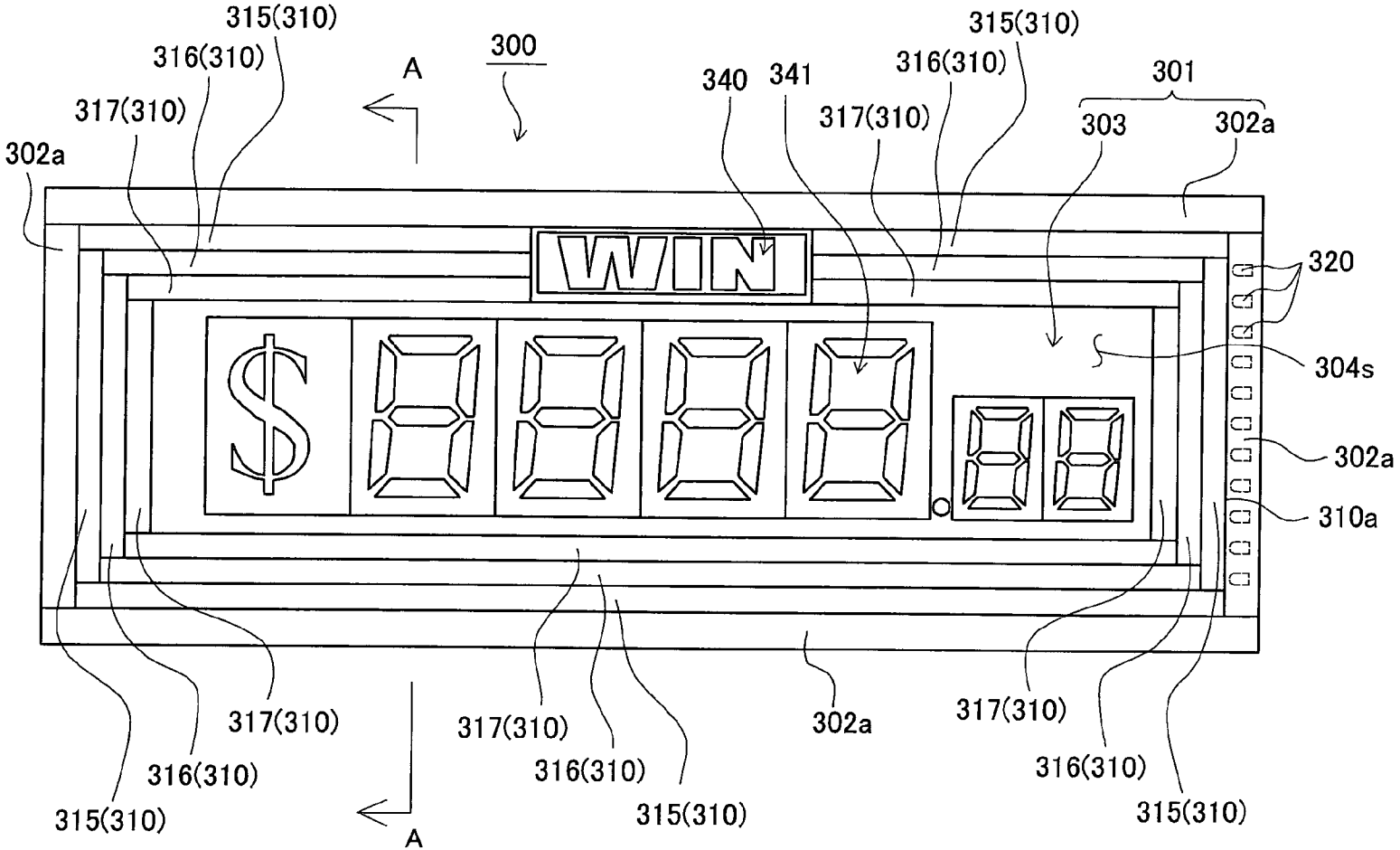
FIG. 2 is a front view of the illuminating device according to one embodiment of the present invention.
Figure 3:
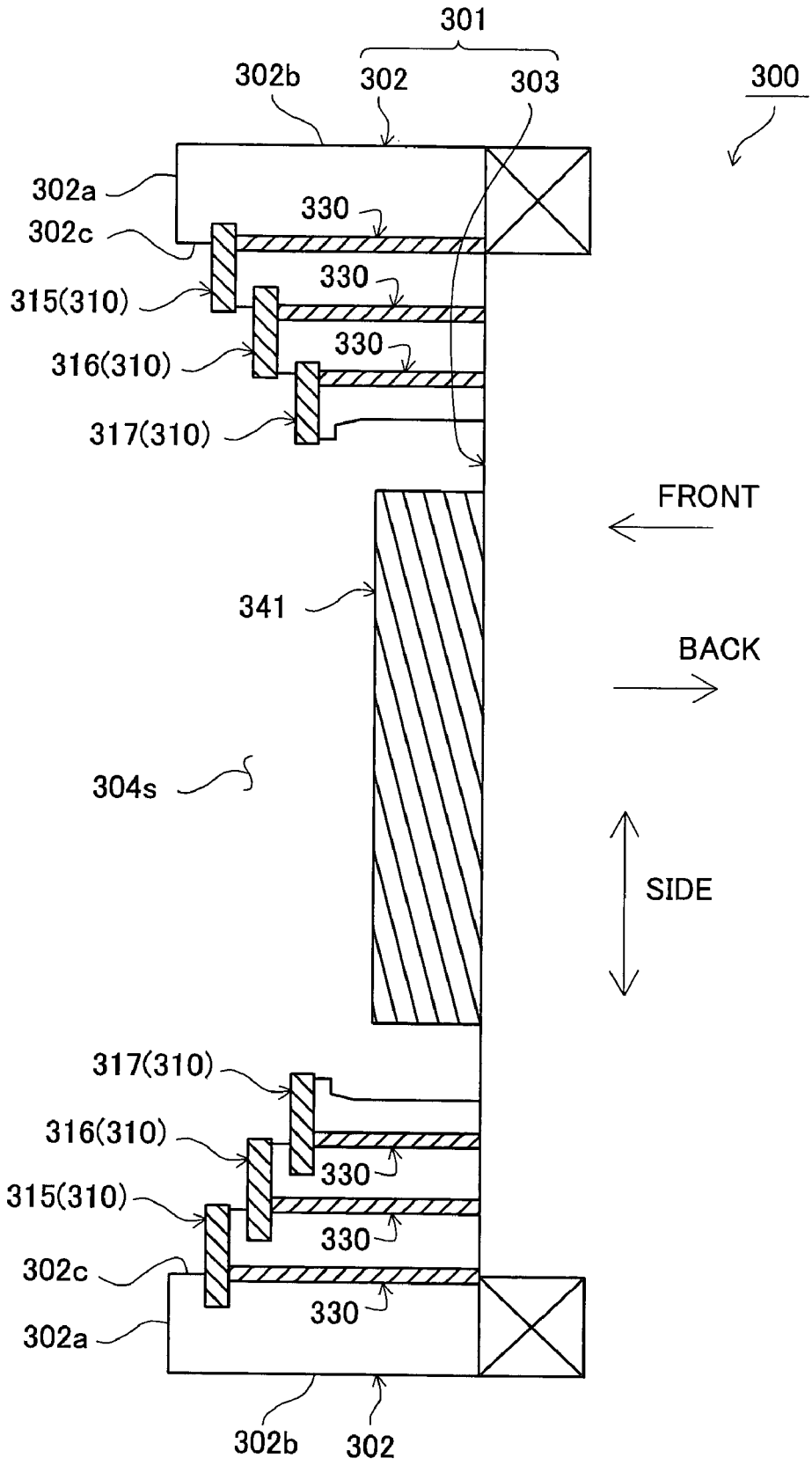
FIG. 3 is a cross sectional view of FIG. 2, taken at the position of arrow A.

As shown in FIG. 2, the housing 301 includes a plate-like base 303, rectangular in shape and extending sideways along its longer sides as viewed from the front, and peripheral walls 302 standing along the rim of the base 303 to surround the entire periphery thereof. By the peripheral walls 302 and the base 303, the housing 301 is box-like in shape with an opening 304*s*.

Each peripheral wall 302 includes a top wall 302*a*, an outer wall 302*b*, and an inner wall 302*c*. The outer wall 302*b* is arranged to project upward from the rim of the base 303. The top wall 302*a* is arranged to extend from an upper end of the outer wall 302*b* toward the opening 304*s*. The inner wall 302*c* is arranged to extend downward from an inner end of the top wall 302*a*, in contact with an illuminating board 315 (310), so that the light emitting portions 320, emitting light to the illuminating board 315, are shielded from outside.

Each illuminating board 310 includes a cloudy, translucent medium 311, a transparent board 312, and a reflector 313, as shown in FIG. 1. The transparent board 312 is a plate-like, transparent acrylic board. The transparent board 312, clear and transparent, allows passage of light without causing much diffusion, so that an object can be seen through it.

The reflector 313 is a white sheet provided over the entire back surface of the transparent board 312 to reflect light.

In other words, the transparent board 312, either independently or in combination with the reflector 313, constitutes a light guide plate. The light guide plate can be described as a plate (member) fabricated by a predetermined treatment performed on a surface of a translucent board such as an acrylic plate, and that produces uniform surface emission from light incident on an end surface, by converting light from a line source, such as a cold cathode tube, or light from a point light source, such as LED, to a surface light source.

The translucent medium 311 is a cloudy, translucent medium provided over the entire front surface of the transparent board 312. For example, the translucent medium 311 is realized by a translucent-white acrylic plate. The translucent medium 311, cloudy and non-transparent, allows passage of light but with diffusion, so that an object cannot be seen through it.

In the present embodiment, the illuminating boards 310 include illuminating boards 315 (310), illuminating boards 316 (310), and illuminating boards 317 (310). As shown in FIG. 2, the top walls 302*a*, constituting the rim of the housing 301, are arranged in the form of a ring, as viewed from the front. The illuminating boards 315 are arranged along the inner sides of the top walls 302*a*, so that the top walls 302, constituting the rim of the housing 301, are adjacent to the illuminating boards 315, as viewed from the front.

The illuminating boards 316 are arranged along the inner sides of the illuminating boards 315 arranged to form a loop, as viewed from the front, so that the illuminating boards 315 and the illuminating boards 316 are adjacent to each other, as viewed from the front. Similarly, the illuminating boards 317 are arranged along the inner sides of the illuminating boards 316 arranged to form a loop, as viewed from the front, so that the illuminating boards 316 and the illuminating boards 317 are adjacent to each other, as viewed from the front.

Figure 4:
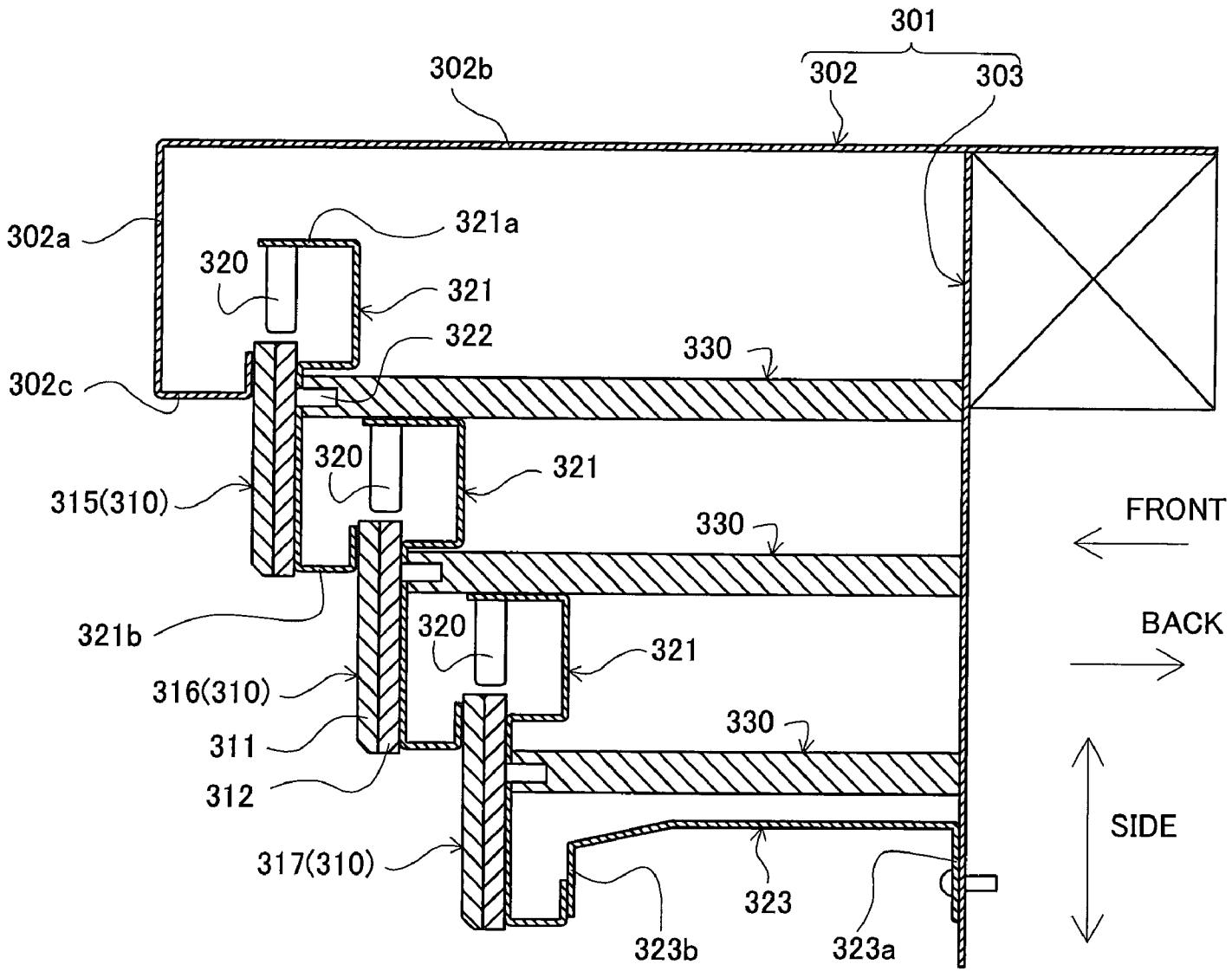
FIG. 4 is a cross sectional view showing details of FIG. 3.

The support members 330 are plate-like members respectively provided for the illuminating boards 315 through 317, supporting these members. As shown in FIG. 4, one end of the support member 330 supporting the illuminating board 315 is on the base 303. The other end of the support member 330 is fastened by a screw 322 to a middle portion of a cover 321, bent in the shape of an S as viewed from the side, and to the back surface at one end of the illuminating board 315. An end 321*a* of the cover 321 is connected to the light emitting portions 320 so that the light emitting portions 320 can emit light to the transparent board 312 at the supported end of the illuminating board 315. The other end of the cover 321, designated by reference numeral 321*b*, is in contact with the illuminating board 316, so that the light emitting portions 320, emitting light to the illuminating board 316, are shielded from outside. As described, the support member 330 supports an end 310*a* of the illuminating board 310 in a cantilever fashion to provide a free end for an end 310*b* of the illuminating board 310. Since this provides a free space at the end 310*b* and beneath the illuminating board 310, efficient arrangement of the illuminating boards 310 is possible and an illuminating device can be realized that has a solid-look. The light emitting portions 320 can emit multiple colors. As shown in FIG. 2, the light emitting portions 320 are disposed at predetermined intervals along the end 310*a* of each illuminating board 310 (the end supported by the support member 330).

As with the illuminating board 315, the illuminating board 316 is supported by the support member 330 in a cantilever fashion. The support member 330 supporting the illuminating board 316, however, is shorter than the support member 330 supporting the illuminating board 315, so that the distance to the illuminating board 316 is shorter than the distance to the illuminating board 315, relative to the base 303. The end 321*b* of the cover 321, supported integral with the illuminating board 316, is in contact with the illuminating board 317, so that the light emitting portions 320, emitting light to the illuminating board 317, are shielded from outside.

The illuminating board 317 is also supported by the support member 330 in a cantilever fashion. The support member 330 supporting the illuminating board 317 is shorter than the support member 330 supporting the illuminating board 316, so that the distance to the illuminating board 317 is shorter than the distance to the illuminating board 316, relative to the base 303. That is, the illuminating boards 310 (315, 316, 317) are arranged in a step-like manner to provide different distances from the base 303, forming a structure with an external appearance suited to provide a solid-look.

The end 321*b* of the cover 321, supported integral with the illuminating board 317, is bent downward, in contact with an end 323*b* of a shield plate 323. The shield plate 323 is screwed to the base 303 at an end 323*a*, so as to shield the support members 330 and the light emitting portions 320 from outside.

As shown in FIG. 2, electric display indicators 341, capable of displaying numbers, are provided on a front surface of the base 303, in a middle portion of the opening 304*s*. The electric display indicators 341 display the amount of bonus payout awarded in a bonus game (hereinafter also referred to as a "multiplayer game"). Further, in an upper middle portion of the opening 304*s*, a WIN light emitting portion 340 is provided that emits red light to display the character "WIN". The WIN light emitting portion 340 emits light when it is determined to award a bonus payout in a multiplayer game. The emission control unit that causes the light emitting portions 320 to emit light is a common unit used to control emission of the light emitting portions 320. For example, the emission control unit is realized by a graphic board 268, as briefly shown in FIG. 12. The emission control unit causes the illuminating boards 315, 316, and 317 to emit light in different colors.

In the following, description is made as to an operation of the illuminating device 300, with reference to FIG. 1.

The light emitted from the light emitting portions 320 enters the translucent medium 311 and the transparent board 312 through the end 310*a* of the illuminating board 310, and travels therein. A part of the incident light on the transparent board 312 enters the translucent medium 311 and emerges outside, while other parts of the light are reflected by the reflector 313 to travel along a redirected path in the transparent board 312, away from the light emitting portion 320, before it enters the translucent medium 311 and emerges outside. The light entering the translucent medium 311 emerges outside by being diffused. In this manner, the transparent board 312 and the reflector 313 cause the light to propagate throughout the translucent medium 311 where the light is diffused. There accordingly will be no nonuniformity of brightness, where the illuminating board 310, when viewed from outside, appears brighter in portions of the transparent board 312 closer to the light emitting portions 320 and darker in portions farther from the light emitting portions 320. The illuminating board 310 appears as though it is uniformly emitting light.

As described, the illuminating device 300 according to the present embodiment includes: illuminating boards 310 each having a plate-like transparent board 312, a reflector 313 provided on a back surface of the transparent board 312 to reflect light, and a cloudy, translucent medium 311 provided on a front surface of the transparent board 312; a support member 330 to support an end 310*a* of each illuminating board 310 in a cantilever fashion to provide a free end for an end 310*b* of the illuminating board 310; light emitting portions 320, arranged beside the end 310*a* of each illuminating board 310, that emit light to the transparent board 312 at the end 310*a*; and an emission control unit that causes the light emitting portions 320 to emit light.

Figure 5A:
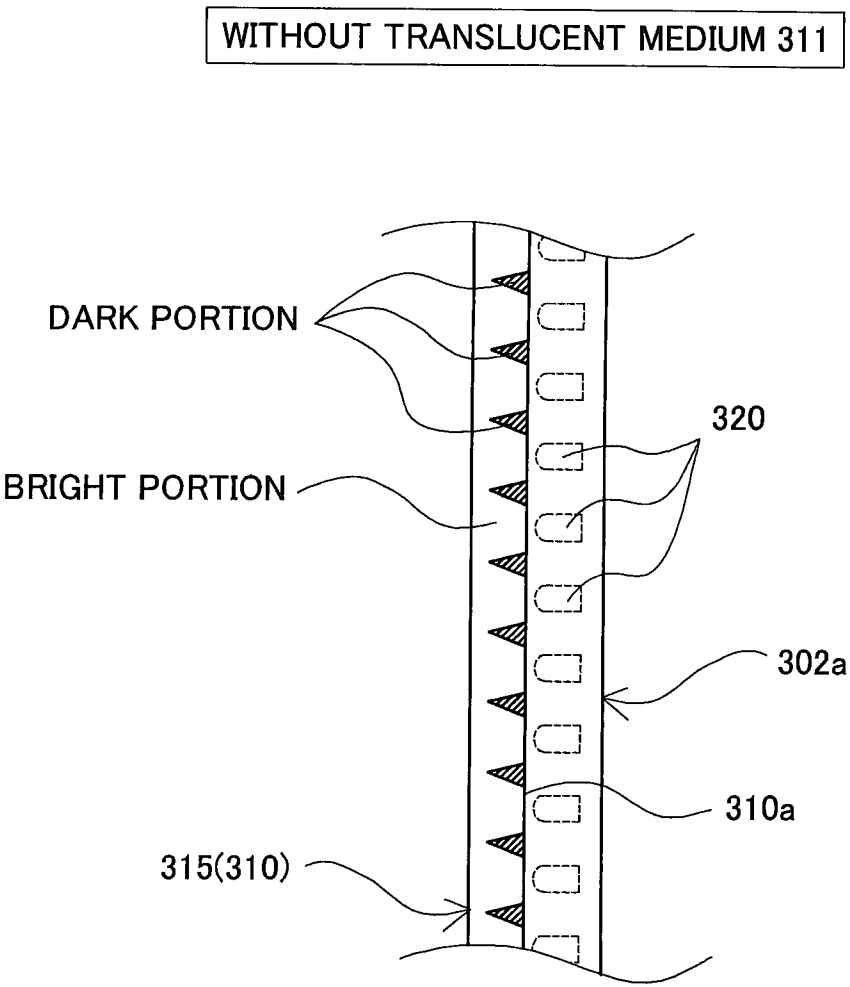
FIG. 5A is a front view illustrating an example of an operation of a conventional illuminating device.
Figure 5B:
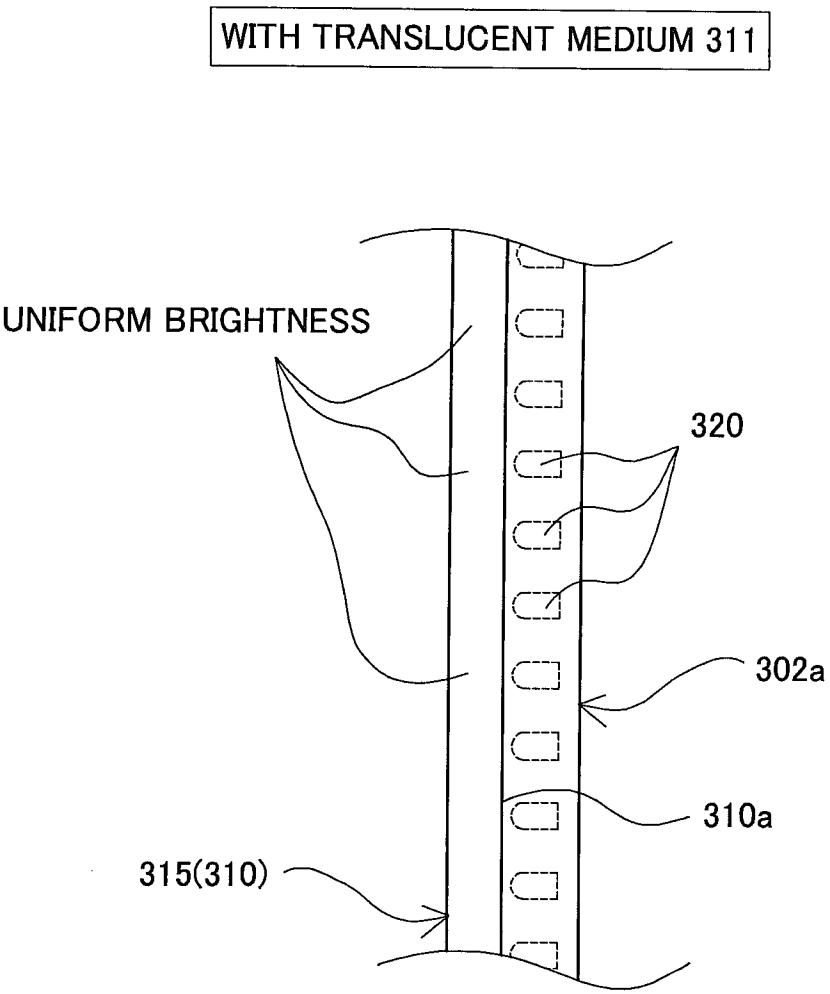
FIG. 5B is a front view illustrating an operation of an illuminating device according to the present invention.

With this structure, the light incident on the transparent board 312 is reflected by the reflector 313 to travel toward portions of the transparent board 312 away from the light emitting portions 320. The light incident on the transparent board 312 travels through the cloudy, translucent medium 311 toward the front side of the illuminating board 310. The light emitting portions 320 are disposed at predetermined intervals along the end 310*a* of each illuminating board 310. When the cloudy translucent medium 311 is not provided, there will be nonuniformity in brightness, where the illuminating board 310 appears brighter in portions closer to the light emitting portion 320 and darker in portions farther away from the light emitting portions 320, as shown in FIG. 5A. The provision of the translucent medium 311 solves the problem of nonuniform brightness attributed to the arrangement of the multiple light emitting portions 320, as shown in FIG. 5B. That is, there is no nonuniformity of brightness, where the transparent board 312 appears brighter in portions closer to the light emitting portions 320 and darker in portions farther away from the light emitting portions 320. The illuminating board 310 appears as though it is uniformly emitting light. Further, by the cantilever arrangement of the illuminating board 310, a free space can be provided at the end 310*b* and beneath the illuminating board 310.

The present invention is particularly suitable when uniform emission is desired at the rim of the housing 301. Emission at the rim of the housing 301 is possible when the peripheral walls 302 of the housing 301 are adjacent to the illuminating boards 310 forming a ring—an arrangement realized by including: a housing 301 having a base 303, and peripheral walls 302 provided along the rim of the base 303; a set of illuminating boards 310 forming a loop as viewed from the front, the illuminating boards 310 each having a plate-like transparent board 312, a reflector 313 provided on a back surface of the transparent board 312 to reflect light, and a cloudy, translucent medium 311 provided on a front surface of the transparent board 312; a support member 330 supporting an end 310*a* of each illuminating board 310 in a cantilever fashion, so as to provide a free end for an end 310*b* of the illuminating board 310, the illuminating boards 310 being adjacent to the peripheral walls 302 as viewed from the front; a light emitting portion 320, arranged beside the end 310*a*, that emits light to the transparent board 312 at the end 310*a*; and an emission control unit that causes the light emitting portion 320 to emit light.

Further, an illuminating device, having a solid-look as viewed from the side, can be provided when the illuminating boards 310 (315, 316, 317) are disposed at different distances from the base 303 of the housing 301. This can be attained by the arrangement including: a housing 301 having a base 303, and peripheral walls 302 provided along the rim of the base 303; plural sets of illuminating boards 310 (315, 316, 317) forming a loop as viewed from the front, the illuminating boards 310 each having a plate-like transparent board 312, a reflector 313 provided on a back surface of the transparent board 312 to reflect light, and a cloudy, translucent medium 311 provided on a front surface of the transparent board 312; a support member 330, provided for each illuminating board 310, supporting an end 310*a* of the illuminating board 310 in a cantilever fashion, so as to provide a free end for an end 310*b* of the illuminating board 310; a light emitting portion 320, arranged beside the end 310*a* of each illuminating board 310, that emits light to the transparent board 312 at the end 310*a*; and an emission control unit that causes the light emitting portion 320 to emit light, wherein the peripheral walls 302 and the sets of illuminating boards 310 (315, 316, 317) are arranged adjacent to one another in this order as viewed from the front, and wherein the sets of illuminating boards 310 (315, 316, 317) are arranged at different distances from the base 303.

The light emitting portions 320 may be adapted to emit multiple colors, and the emission control unit may be adapted to cause the light emitting portions 320 to emit light in different colors. In this way, an illuminating device can be provided that can produce a wide variety of attractive, different colors.

While the foregoing description dealt with one embodiment of the present invention, the specific structures of the respective components are not limited to the ones described above.

For example, the translucent medium 311 and the reflector 313, respectively described as a translucent-white acrylic plate and a white sheet, may be translucent-white and white, blue-white and white, blue-white and blue, red-white and white, or red-white and red, respectively.

It is particularly effective to use similar colors for the translucent medium 311 and the reflector 313, because it masks the no uniform brightness even when the cloudiness of the translucent medium 311 is small, making it possible to produce apparently uniform emission throughout the illuminating board 310. Use of various kinds of translucent media with different degrees of cloudiness, and use of low-cost materials effectively allow greater design freedom and reduce costs.

Various other modifications to the other structures are possible within the scope of the present invention.

The following describes an embodiment of a gaming machine using the illuminating device 300 according to the present invention described above, with reference to FIG. 6 through FIG. 16.

Figure 7:
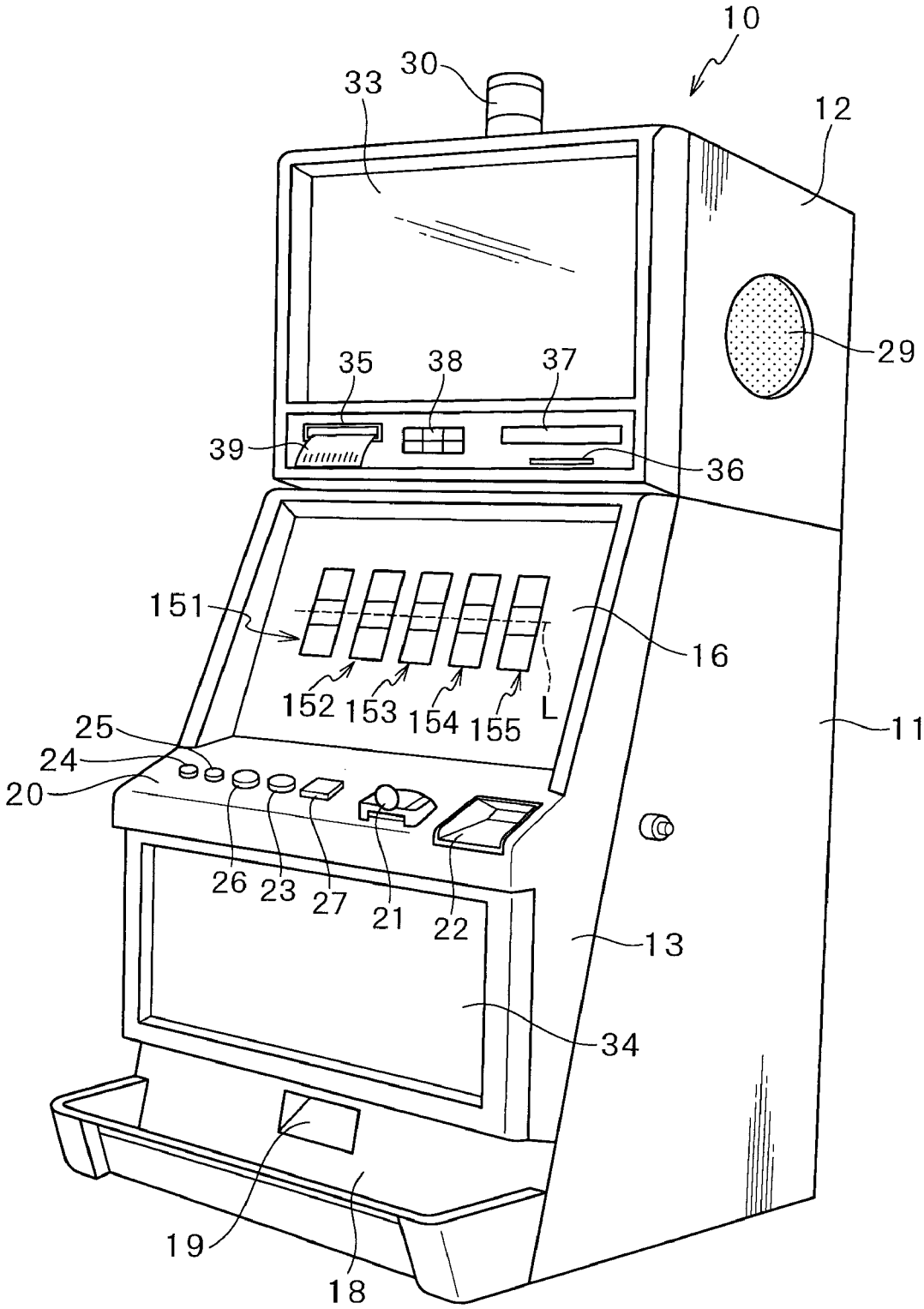
FIG. 7 is a perspective view illustrating an external appearance of the gaming terminal.

As illustrated in FIG. 7, the terminal display 101 has arrangement areas 150, and symbols are arranged in the arrangement areas 150.

The "arranging" in this specification means a state where the symbols can be visually observed by a player. That is, the wording means a state where the symbols are displayed in the arrangement areas 150, in FIG. 7. Arranging the symbols again after dismissing the symbols is referred to as rearranging.

The terminal display 101 may have a mechanical structure adopting a reel device which rotates a reel to arrange the symbols. Alternatively, the terminal display 101 may have an electrical structure in which a video reel is displayed as an image and symbols on a video reel are arranged in the form of an image. Further, the terminal display 101 may adopt a combination of the mechanical structure (reel) and the electrical structure (video reel). Examples of the electrical structure include a liquid crystal display device, a CRT (cathode-ray tube), a plasma display device, or the like. Further, the number of arrangement areas 150 is not limited. A specific structure of the terminal display 101 will be detailed later.

A bonus payout indicator 300, provided as an illuminating device 300 according to the present invention, displays the amount of bonus payout awarded in a bonus game. In the example shown in FIG. 6, the bonus payout is displayed as a progressive jackpot amounting $1234.56. In this embodiment, the bonus payout indicator 300 is structured to include arrays of LEDs provided as light emitters. However, the bonus payout indicator 300 may be structured as a single liquid crystal display. The light emitters are not limited to LEDs (light-emitting diodes) so long as light is emitted.

Paths 401 are realized by arrays of light emitting portions 403 forming a channel connecting a position 402, corresponding to each gaming terminal 10, to the bonus payout indicator 300. In this manner, the paths 401 are provided to correspond to the gaming terminals 10.

The light emitting portions 403 are realized by LEDs (light-emitting diodes), and are capable of emitting light in different colors. The light emitting portions 403 are lighted when activated. The light emitting portions 403 are controlled to be activated one after another, from the position 402, corresponding to each gaming terminal 10, to the bonus payout indicator 300.

The light emitting portions 403 are not limited to LEDs as long as light is emitted. The activation state is not limited to a lighting state and may be a flashing state. The light emitting portions 403 may be adapted to emit only one color; however, it is preferable that the light emitting portions 403 be capable of emitting more than one color to provide a wide variety of effects.

(Running Base Game)

The following specifically describes an example of a base game in the gaming machine 1. Note that the following example deals with a case where the terminal display 101 adopts a video reel and arranges symbols on a video reel.

As illustrated in FIG. 7, a matrix 156 is in the center of the terminal display 101. The matrix 156 includes symbols, which are scroll displayed. The display windows 151 to 155 are respectively divided into upper stages 151*a* to 155*a*, central stages 151*b* to 155*b*, and lower stages 151*c* to 155*c*. The symbols are stopped (arranged) in the stages 151*a* to 155*a*, 151*b* to 155*b*, and 151*c* to 155*c*, respectively. The matrix 156 is a symbol matrix including five columns/three rows. The matrix 156 however is not limited to the one with the five-columns/three-rows.

The terminal display 101 variably displays symbols when a base game is started in the gaming terminal 10. When this variable-displaying of symbols stops, symbols are rearranged in the arrangement areas 150. Then, when a winning is met according to a relation among the rearranged symbols, a payout according to this winning is awarded.

Figure 6:
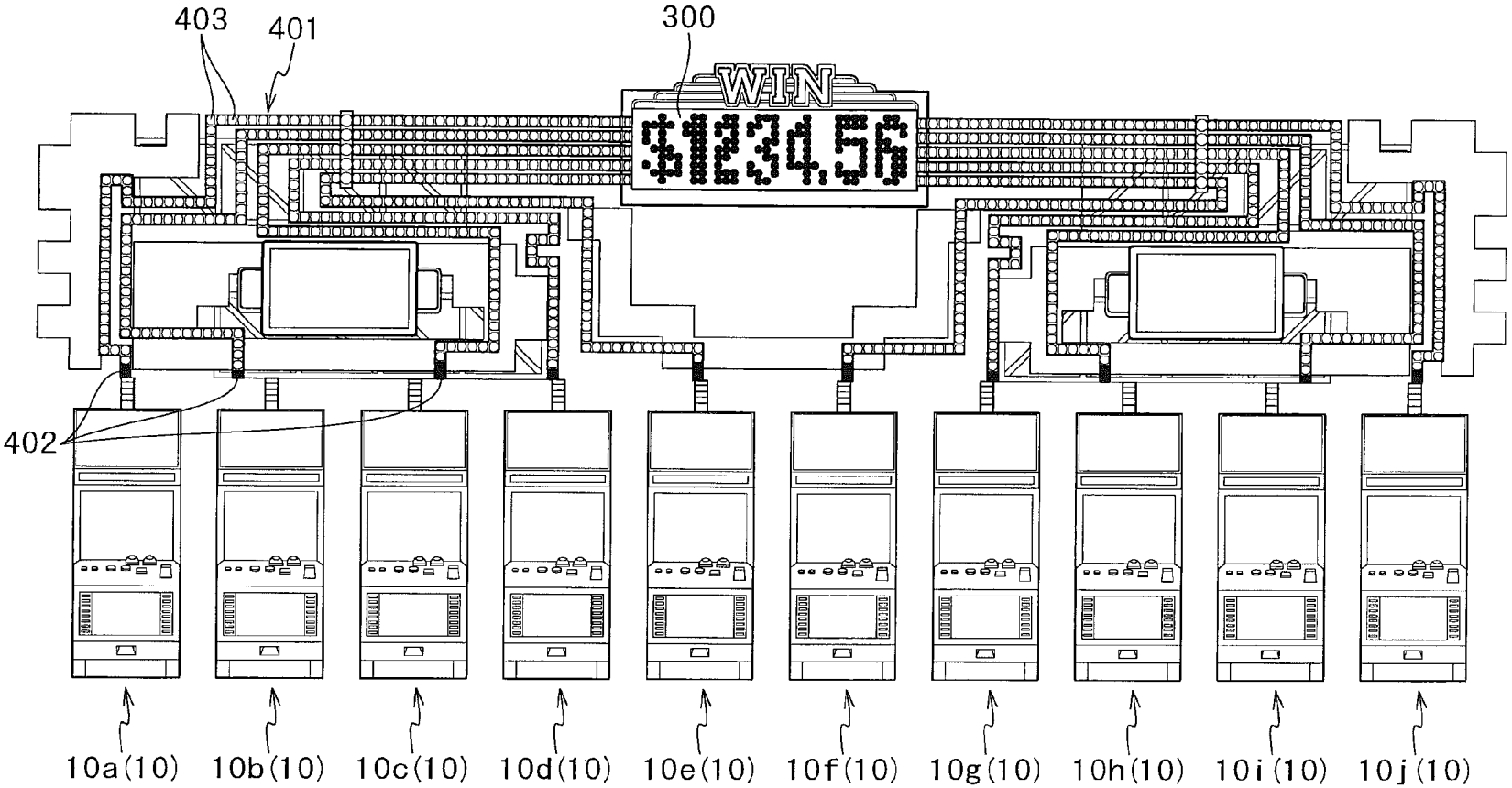
FIG. 6 is a front view illustrating an external appearance of the gaming machine.

Note that, part of the bet made by the player is accumulated in the form of a jackpot value, every time a base game is started. The jackpot value so accumulated is displayed in the bonus payout indicator 300, as illustrated in FIG. 6.

(Running Bonus Game)

The following specifically describes an example of a bonus game in the gaming machine 1.

A bonus game is started when the accumulated jackpot value exceeds a certain value. In a bonus game, the symbols are rearranged in the matrix 156 in each gaming terminal 10. When a predetermined winning is met by the rearrangement of the symbols, the light emitting portions 403 turn active in random numbers, in the path 401 corresponding to the gaming terminal 10 in which the winning has occurred. This operation is repeated until the light emitting portions 403 in any of the paths 401 are activated up to the bonus payout indicator 300.

When the light emitting portions 403 are activated all the way up to the bonus payout indicator 300, a jackpot is awarded as a bonus payout in the gaming terminal 10 corresponding to the path 401 in which the light emitting portions 403 turned active up to the bonus payout indicator 300.

[Symbol, Combination, or the Like]

The terminal display 101 has the matrix 156 including symbol columns each having twenty two symbols, as illustrated in FIG. 8. To each of the symbols constituting the columns is given one of code numbers 0 to 21. Each symbol column is made from a combination of "Angelfish", "Clownfish", "7", "Tuna", "Coelacanth", and "Bonus".

Of the symbols in the symbol columns, the display windows 151 to 155 each displays (arranges) three successive symbols. The symbols arranged in the upper stages 151*a* to 155*a*, the central stages 151*b* to 155*b*, and the lower stages 151*c* to 155*c* form a symbol matrix having five columns and three rows. When a BET button and a start button are sequentially pressed in this order to start a game, symbols constituting the symbol matrix start to scroll. This scrolling of the symbols stops (rearrangement) after a predetermined period from the beginning of the scrolling.

Further, for each symbol, a predetermined scatter symbol is determined in advance. Scatter symbols are such symbols that a player is put in an advantageous position when a predetermined number or more of them are displayed in the matrix 156. For example, the advantages include: a state where coins corresponding to the scatter symbols are paid out, a state where the number of coins to be paid out is added to a credit, a state where a bonus game is started.

Here, a bonus game is a gaming state which provides a larger advantage than a base game. In this embodiment, the bonus game is a jackpot game. No particular limitation is put on the bonus game, as long as it is a gaming state advantageous to the player, that is, it is more advantageous than the base game. For example, the bonus game may include a state where more game media are obtainable than in the base game, a state where a game medium is obtainable with higher probability than in the base game, a state where a game medium is less consumed than in the base game, and the like. Specifically, a free game, a second game, a feature game, and the like may be mentioned as examples of the bonus game.

[Mechanical Structure of Gaming Machine 1]

Next, the following describes a specific example of mechanical and electrical structures of the gaming machine 1 thus structured.

A gaming machine 1 is placed in a gaming facility such as a casino. This gaming machine 1 runs a unit game which involves a game medium. The game medium is a coin, bill, or a value in the form of electronic information. However, the game medium in the present invention is not particularly limited. For example, a medal, token, electronic money, ticket or the like are also possible. Further, the ticket is not particularly limited and may be a later-described ticket with a barcode or the like ticket.

As illustrated in FIG. 6, the gaming machine 1 includes: gaming terminals 10 that independently run a base game; a center controller 200, connected to and in communication with the gaming terminals 10, that runs a bonus game; a bonus payout indicator 300 that displays the amount of a bonus payout awarded in a bonus game; and paths 401 each including the light emitting portions 403 arranged to form a channel extending from the position 402 corresponding to each gaming terminal 10 to the bonus payout indicator 300.

As illustrated in FIG. 7, the gaming terminal 10 includes: a cabinet 11, a top box 12 provided above the cabinet 11, and a main door 13 provided on the front surface of the cabinet 11. The main door 13 has a lower image display panel 16. The lower image display panel 16 has a transparent liquid crystal panel for displaying various information. The lower image display panel 16 displays display windows 151 to 155 (matrix 156) for arranging therein symbols. Further, the lower image display panel 16 displays as needed various information and effect images related to a game.

The present embodiment deals with a case where the lower image display panel 16 electrically displays symbols arranged in five rows/three columns. However, the present invention is not limited to this.

The lower image display panel 16 displays a single activated payline L. Note that the number of pay lines L may be two or more. When the number of pay lines L is two or more, the number of pay lines L activated may be determined according to a predetermined condition, such as the number of coins placed as a BET.

Note that the lower image display panel 16 may have a credit value indicator and a payout value indicator. The credit value indicator displays a total value (hereinafter also referred to as total credit value) which a gaming terminal 10 can pay out to a player. When symbols stopped along a pay line L form a winning combination, the payout value indicator displays the number of coins to be paid out.

Further, scatter symbols may be adopted, and the number of coins to be paid out may be determined, according to the number of scatter symbols displayed on the matrix 156. Note that the pay line L does not necessarily have to be displayed.

Below the lower image display panel 16 provided are a control panel 20, a coin insertion slot 21, and a bill validator 22. The control panel 20 is provided with various buttons 23 to 27. These buttons 23 to 27 allow a player to input instructions related to a game played by the player. Through the coin insertion slot 21, a coin is received in the cabinet 11.

The control panel 20 includes: a spin button 23, a change button 24, a cashout button 25, a 1-BET button 26, and a maximum BET button 27. The spin button 23 is for inputting an instruction to start symbol scrolling. The change button 24 is used to ask a staff person in the gaming facility for exchange of money. The cashout button 25 is for inputting an instruction to pay out coins corresponding to the total credit-value into the coin tray 18.

The 1-BET button 26 is used for betting one coin out of those corresponding to the total credit value. The maximum BET button 27 is used for betting, out of those corresponding to the total credit value, a maximum number of coins (e.g., fifty coins) which can be bet in one game.

The bill validator 22 validates whether bill is genuine or not and receives the genuine bill into the cabinet 11. Note that the bill validator 22 is capable of reading a barcode attached to a later-mentioned ticket 39 having a barcode (hereinafter simply referred to as ticket 39). When the bill validator 22 reads the ticket 39, it outputs to the main CPU 41 a read signal representing information having read from the barcode.

On the lower front surface of the main door 13, that is, below the control panel 20, a belly glass 34 is provided. On the belly glass 34, a character of a gaming terminal 10 or the like is drawn. On the front surface of top box 12 is provided an upper image display panel 33. The upper image display panel 33 has a liquid crystal panel and displays an effect image, introduction to the game, rules of the game, or the like.

Further, the top box 12 has a speaker 29 for performing an audio output. Below the upper image display panel 33 are provided a ticket printer 35, a card reader 36, a data displayer 37, and a keypad 38. The ticket printer 35 prints, onto a ticket, a barcode having encoded data containing credit-value, date and time, identification number of a gaming terminal 10 or the like, thereby issuing a ticket 39 having a barcode attached thereto. A player can play a game in another gaming terminal 10 with the ticket 39 having the barcode, or exchange the ticket 39 having the barcode with bill or the like at a change booth or the like of the game arcade.

The card reader 36 reads/writes data from/into a smart card. The smart card is carried by a player, and stores therein data for identifying the player, data relating to a history of games played by the player, or the like.

The data displayer 37 includes a fluorescent display or the like, and displays the data read by the card reader 36 and the data input by the player through the keypad 38. The keypad 38 is for entering instructions or data relating to issuing of a ticket or the like.

[Electrical Structure of Gaming Machine 1]

Figure 11:
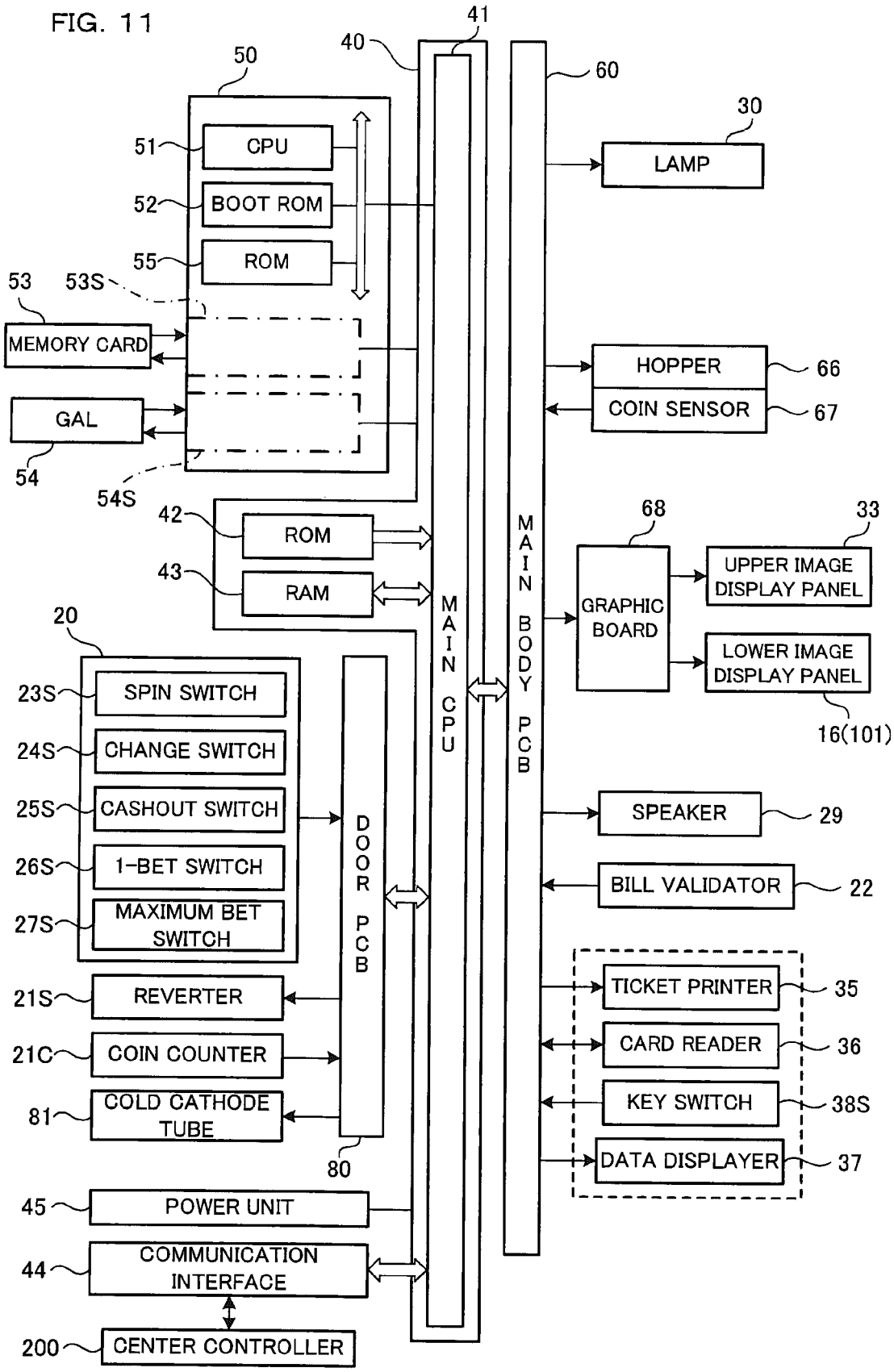
FIG. 11 is a block diagram illustrating an electrical structure of the gaming terminal.
Figure 12:
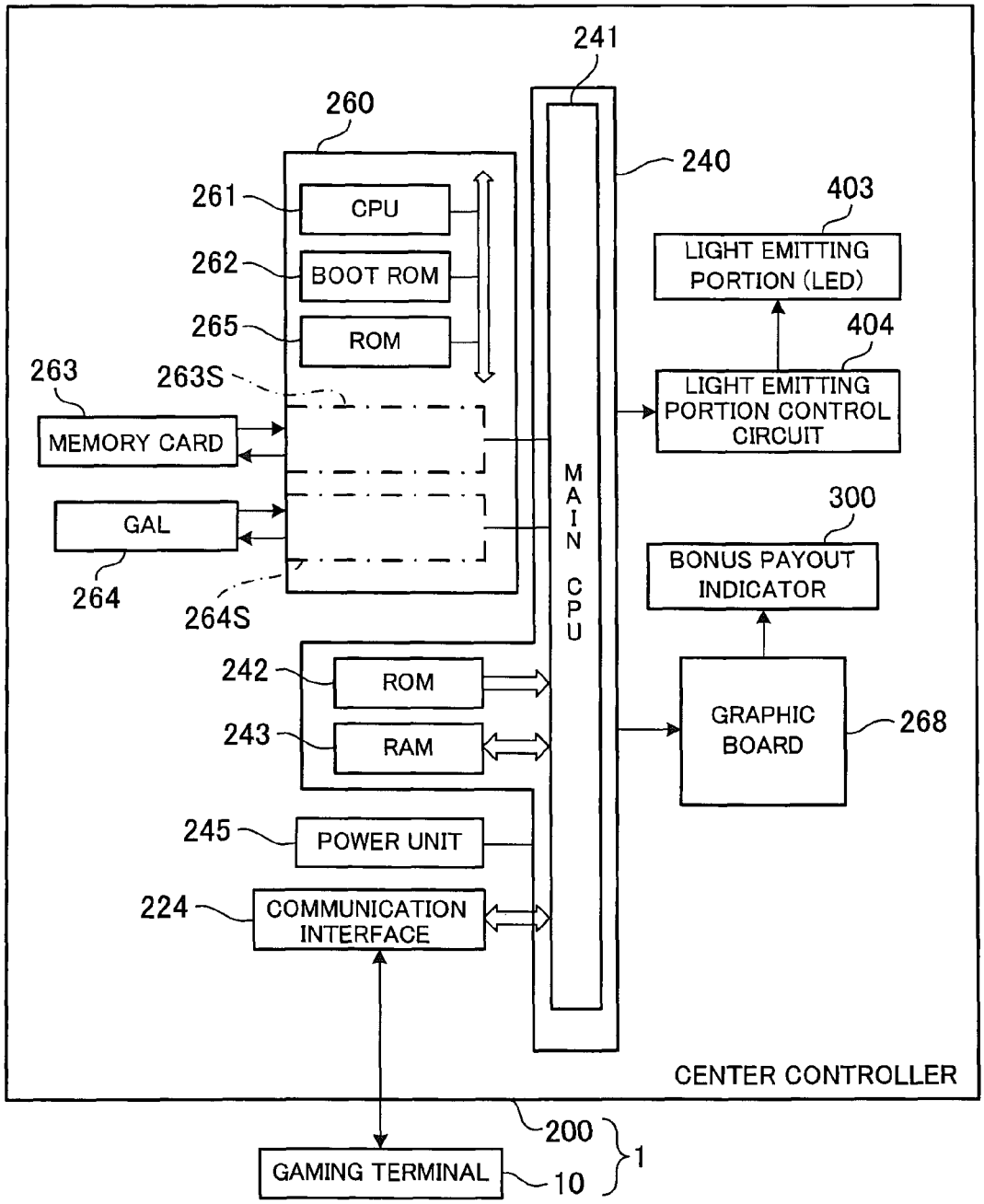
FIG. 12 is a block diagram illustrating an electrical structure of a center controller.

FIGS. 11 and 12 are block diagrams each illustrating an electrical structure of the entire gaming machine 1.

(Electrical Structure of Gaming Terminal 10)

FIG. 11 is a block diagram showing an electrical structure of the gaming terminal 10. As illustrated in FIG. 11, the cabinet 11 includes a control unit having a terminal controller 100. As illustrated in FIG. 11, the control unit includes a motherboard 40, a main body PCB (Printed Circuit Board) 60, a gaming board 50, a door PCB 80, various switches, sensors, or the like.

The gaming board 50 is provided with a CPU (Central Processing Unit) 51, a ROM 55, a boot ROM 52, a card slot 53S corresponding to a memory card 53, and an IC socket 54S corresponding to a GAL (Generic Array Logic) 54. The CPU 51, the ROM 55, and the boot ROM 52 are connected to one another through an internal bus.

The memory card 53 stores therein a game program and a game system program. The game program contains a stop symbol determining program. The stop symbol determining program determines symbols (code number corresponding to the symbol) to be stopped in the arrangement areas 150. This stop symbol determining program contains sets of symbol weighting data respectively corresponding to various payout rates (e.g., 80%, 84%, 88%). Each set of the symbol weighting data indicates, for each of the display windows 151 to 155, a code number of each symbol and at least one random numerical value allotted to the code number. The numerical value is a value within a predetermined range of 0 to 256 for example.

The payout rate is determined based on payout rate setting data output from the GAL 54. Based on a set of the symbol weighting data corresponding to the payout rate determined, a symbol to be stopped is determined.

The memory card 53 stores therein various types of data for use in the game programs and the game system programs. For example, the memory card 53 stores a table listing combinations of a symbol to be displayed on the display windows 151 to 155 of FIG. 1 and an associated range of random numerical values. This data is transferred to the RAM 43 of the motherboard 40, at the time of running a game programs.

The card slot 53S is structured so as to allow the memory card 53 to be attached/detached to/from the card slot 53S. This card slot 53S is connected to the motherboard 40 through an IDE bus. Thus, the type and content of a game run by a gaming terminal 10 can be modified by detaching the memory card 53 from the card slot 53S, writing a different game program and a different game system program into the memory card 53, and inserting the memory card 53 back into the card slot 53S.

Each of the game programs includes a program related to the progress of the game and/or a program for causing a transition to a bonus game. Each of the game programs includes image data and audio data output during the game.

The GAL 54 has input and output ports. When the GAL 54 receives data via the input port, it outputs data corresponding to the input data from its output port. This data from the output port is the payout rate setting data described above.

IC socket 54S is structured so as to allow the GAL 54 to be attached/detached to/from the IC socket 54S. The IC socket 54S is connected to the motherboard 40, via a PCI bus. Thus, the payout rate setting data to be output from GAL 54 can be modified by: detaching the GAL 54 from the IC socket 54S, overwriting the program stored in the GAL 54, and attaching the GAL 54 back to the IC socket 54S.

The CPU 51, the ROM 55 and the boot ROM 52 connected through an internal bus are connected to the motherboard 40 through the PCI bus. The PCI bus communicates signals between the motherboard 40 and the gaming board 50 and supplies power from the motherboard 40 to the gaming board 50. The ROM 55 stores country identification information and an authentication program. The boot ROM 52 stores a preliminary authentication program and a program (boot code) for enabling the CPU 51 to run the preliminary authentication program.

The authentication program is a program (falsification check program) for authenticating the game program and the game system program. The authentication program is a program for confirming and verifying that the game program and the game system program are not falsified. In other words, the authentication program is described in accordance with a procedure for authenticating the game program and the game system program. The preliminary authentication program is a program for authenticating the authentication program. The preliminary authentication program is described in accordance with a procedure for verifying that the authentication program to be authenticated is not falsified. In short, the preliminary authentication program authenticates the authentication program.

The motherboard 40 is provided with a main CPU 41 (terminal controller 100), a ROM (Read Only Memory) 42, a RAM (Random Access Memory) 43, and a communication interface 44.

The main CPU 41 serves as a terminal controller 100 and has a function of controlling the entire gaming terminal 10. In particular, the main CPU 41 controls the following operations: an operation of outputting a signal instructing variable-displaying of symbols to the graphic board 68, which is performed in response to pressing of the spin button 23 after betting of credit; an operation of determining symbols to be stopped after the variable-displaying of symbols; and an operation of stopping the symbols thus determined in the display window 151 to 155.

In other words, the main CPU 41 serves as an arrangement controller which arranges symbols to form a new symbol matrix through scrolling of symbols displayed on the lower image display panel 16. This main CPU 41 therefore determines symbols to be arranged in a symbol matrix by selecting symbols to be arranged from various kinds of symbols. Then, the main CPU 41 executes arrangement control to stop scrolling the symbols to present the symbols thus determined.

The ROM 42 stores a program such as BIOS (Basic Input/Output System) run by the main CPU 41, and permanently-used data. When the BIOS is run by the main CPU 41, each of peripheral devices is initialized and the game program and the game system program stored in the memory card 53 are read out through the gaming board 50. The RAM 43 stores data or a program used for the main CPU 41 to perform a process.

The communication interface 44 is provided to communicate with a host computer and the like equipped in the gaming facility, through the network (communication line). The communication interface 44 is also for communicating with the center controller 200 through a communication line. Further, a main body PCB (Printed Circuit Board) 60 and a door PCB 80 are connected to the motherboard 40, through USB (Universal Serial Bus). Further, the motherboard 40 is connected to a power unit 45. The power unit 45 supplies power to the motherboard 40 to boot the main CPU 41 thereof. Meanwhile, the power unit 45 supplies power to the gaming board 50 through the PCI bus to boot the CPU 51 thereof.

The main body PCB 60 and door PCB 80 are connected to various devices or units which generate signals to be input to the main CPU 41, and various devices or units whose operations are controlled by signals from the main CPU 41. Based on a signal input to the main CPU 41, the main CPU 41 runs the game program and the game system program stored in the RAM 43, to perform an arithmetic process. Then, the main CPU 41 stores the result of the arithmetic process in the RAM 43, or transmits a control signal to the various devices and units to control them based on the result.

The main body PCB 60 is connected with a lamp 30, a hopper 66, a coin sensor 67, a graphic board 68, the speaker 29, a bill validator 22, a ticket printer 35, a card reader 36, a key switch 38S, and a data displayer 37.

The lamp 30 is turned on/off on the basis of a control signal from the main CPU 41.

The hopper 66 is mounted in the cabinet 11 and pays out a predetermined number of coins from a coin outlet 19 to the coin tray 18, based on a control signal from the main CPU 41. The coin sensor 67 is provided inside the coin outlet 19, and outputs a signal to be input to the main CPU 41 upon sensing that a predetermined number of coins have been delivered from the coin outlet 19.

The graphic board 68 controls image displaying of upper image display panel 33 and the lower image display panel 16, based on a control signal from the main CPU 41. Further, the graphic board 68 is provided with a VDP (Video Display Processor) for generating image data on the basis of a control signal from the main CPU 41, a video RAM for temporarily storing the image data generated by the VDP, or the like. Note that image data used at the time of generating the image data by the VDP is in a game program which is read out from the memory card 53 and stored in the RAM 43.

The bill validator 22 reads an image on the bill and takes only those recognized as to be genuine into the cabinet 11. When taking in a genuine bill, the bill validator 22 outputs an input signal indicating the value of the bill to the main CPU 41. The main CPU 41 stores into the RAM 43 a credit-value corresponding to the value of the bill indicated by the signal.

The ticket printer 35 prints a barcode onto a ticket to issue a ticket 39 having the barcode. The barcode contains encoded data such as credit-value stored in the RAM 43, date and time, identification number of the gaming terminal 10, or the like, based on a control signal from the main CPU 41.

The card reader 36 reads out data from the smart card and transmits the data to the main CPU 41. Further, the card reader 36 writes data into the smart card based on the control signal output from the main CPU 41. The key switch 38S is mounted to the keypad 38, and outputs a signal to the main CPU 41 in response to an operation of the keypad 38 by the player. The data displayer 37 displays, based on a control signal from the main CPU 41, the data read by the card reader 36 or the data input by the player through the keypad 38.

The door PCB 80 is connected to a control panel 20, a reverter 21S, a coin counter 21C, and a cold cathode tube 81. The control panel 20 is provided with: a spin switch 23S associated with the spin button 23; a change switch 24S associated with the change button 24; a cashout switch 25S associated with the cashout button 25; a 1-BET switch 26S associated with the 1-BET button 26; and a maximum BET switch 27S associated with the maximum BET button 27. Each of the switches 23S to 27S outputs a signal to the main CPU 41, when a player presses the associated button.

The coin counter 21C is provided within the coin insertion slot 21, and identifies whether the coin inserted into the coin insertion slot 21 by the player is genuine. A coin except the genuine coin is discharged from the coin outlet 19. In addition, the coin counter 21C outputs an input signal to the main CPU 41 upon detection of a genuine coin.

The reverter 21S is operated on the basis of the control signal output from the main CPU 41 and distributes a coin, which is recognized as a genuine coin by the coin counter 21C, to a not-shown cash box or hopper 66 mounted in the gaming terminal 10. In other words, when the hopper 66 is full of the coins, the genuine coin is distributed into the cash box by the reverter 21S. On the other hand, when the hopper 66 is not yet full with the coins, the genuine coin is distributed into the hopper 66. The cold cathode tube 81 functions as a backlight mounted to rear sides of the lower image display panel 16 and the upper image display panel 33. This cold cathode tube 81 turns on according to a control signal from the main CPU 41.

(Electrical Structure of Center Controller 200)

FIG. 12 is a block diagram illustrating an electrical structure of the center controller 200. The center controller 200 is provided therein with a control unit. As illustrated in FIG. 12, the control unit includes a motherboard 240, a gaming board 260, an actuator, or the like.

The gaming board 260 has the same structure as that of the gaming board 50. The motherboard 240 has the same structure as that of the motherboard 40. The communication interface 244 communicates with the terminal controller 100 through a communication line.

The graphic board 268 has the same structure as that of the graphic board 68, except that the graphic board 268 controls displaying of the bonus payout indicator 300 (including emission control of the light emitting portions 320) based on a control signal from the main CPU 241.

A light emitting portion control circuit 404 controls the operation of the LEDs provided as the light emitting portions 403, and activates and inactivates the light emitting portions 403 based on the control signal output from the main CPU 241.

(Path Table)

FIG. 9 is a diagram showing a path table. The path table is stored in a ROM 242, and indicates the number of light emitting portions 403 arranged in each path 401. For example, the path table indicates that the paths 401*a*, 401*b*, 401*c*, and 401*j* include 100, 110, 120, and 100 light emitting portions 403, respectively.

(Path Activation State Table)

FIG. 10 is a diagram showing a path activation state table. The path activation state table is stored in a RAM 243. The path activation state table indicates, for each path 401, the number of activated light emitting portions 403, the number of light emitting portions 403 yet to be activated, the number of winnings met, and the remaining number of potential winnings. For example, the path activation state table indicates that, in the path 401*a*, the number of activated light emitting portions 403 is ten, ninety light emitting portions 403 are to be activated, one winning has been met, and there are four potential winnings.

In the path activation state table shown in FIG. 10, the following random numbers are determined when a winning is met in each path 401: 1 to 87 for the path 401*a*, 1 to 106 for the path 401*b*, 1 to 20 for the path 401*c*, and 1 to 67 for the path 401*j*, all inclusive.

[Operation of Gaming Machine 1: Boot Process]

The following describes a boot process routine which takes place in the gaming machine 1. Upon powering on the gaming machine 1, a boot process routine shown in FIG. 13 starts in: the motherboard 240 and gaming board 260 in the center controller 200, and in the motherboard 40 and the gaming board 50 in the terminal controller 100. The memory cards 53 and 263 are assumed to be inserted into the card slots 53S and 263S of the gaming boards 50 and 260, respectively. Further, the GALs 54 and 264 are assumed to be attached to the IC sockets 54S and 264S, respectively.

First, turning on the power switch of (powering on) the power units 45 and 245 boots the motherboards 40 and 240, and the gaming boards 50 and 260. Booting the motherboards 40 and 240 and the gaming boards 50 and 260 starts separate processes in parallel. Specifically, the CPUs 51 and 261 read out preliminary authentication programs stored in the boot ROMs 52 and 262, respectively. Then, preliminary authentication is performed according to the read out programs so as to confirm and authenticate that no modification is made to authentication programs, before reading them in the motherboards 40 and 240, respectively (S1). Meanwhile, the main CPUs 41 and 241 of the motherboards 40 and 240 run BIOS stored in the ROMs 42 and 242 to load into the RAMs 43 and 243 compressed data built in the BIOS, respectively (S2). Then, the main CPUs 41 and 241 run a procedure of the BIOS according to the data loaded into the RAMs 43 and 243 so as to diagnose and initialize various peripheral devices (S3).

The main CPUs 41 and 241, which are respectively connected to the ROMs 55 and 265 of the gaming boards 50 and 260 via PCI buses, read out authentication programs stored in the ROMs 55 and 265 and stores them in the RAMs 43 and 243 (S4). During this step, the main CPUs 41 and 241 each derives a checksum through ADDSUM method (a standard check function) which is adopted in a standard BIOS, and store the authentication programs into RAMs 43 and 243 while confirming if the operation of storing is carried out without an error.

Next, the main CPUs 41 and 241 each checks what connects to the IDE bus. Then, the main CPUs 41 and 241 access, via the IDE buses, to the memory cards 53 and 263 inserted into the card slots 53S and 263S, and read out game programs and game system programs from the memory cards 53 and 263, respectively. In this case, the main CPUs 41 and 241 each reads out four bytes of data constituting the game program and the game system program at one time. Next, according to the authentication programs stored in the RAMs 43 and 243, the main CPUs 41 and 241 authenticate the game program and the game system program read out to confirm and prove that these programs are not modified (S5).

When the authentication properly ends, the main CPUs 41 and 241 write and store the authenticated game programs and game system programs in RAMs 43 and 243 (S6).

Next, the main CPUs 41 and 241 access, via the PCI buses, to the GALs 54 and 264 attached to the IC socket 54S•264S, and read out payout rate setting data from the GALs 54 and 264, respectively. The payout rate setting data read out is then written and stored in the RAMs 43 and 243 (S7).

Next, the main CPUs 41 and 241 read out, via the PCI buses, country identification information stored in the ROMs 55 and 265 of the gaming boards 50 and 265, respectively. The country identification information read out is then stored in the RAMs 43 and 243 (S8).

Figure 15:
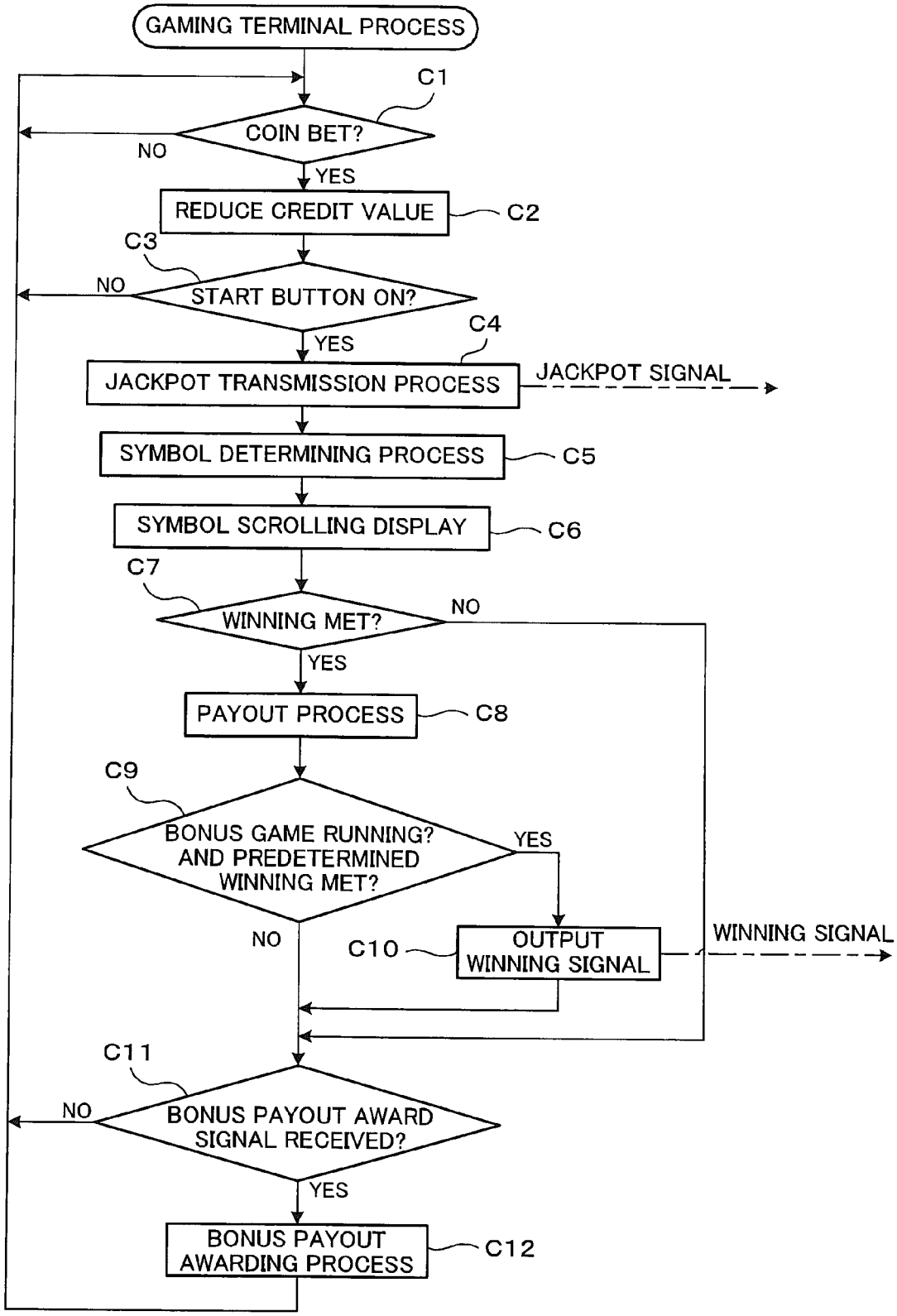
FIG. 15 is a flowchart illustrating a terminal process routine executed in the gaming terminal.

After this, the main CPUs 41 and 241 each perform an initial process of FIG. 15.

[Operation of Gaming Machine 1: Initial Process]

Figure 13:
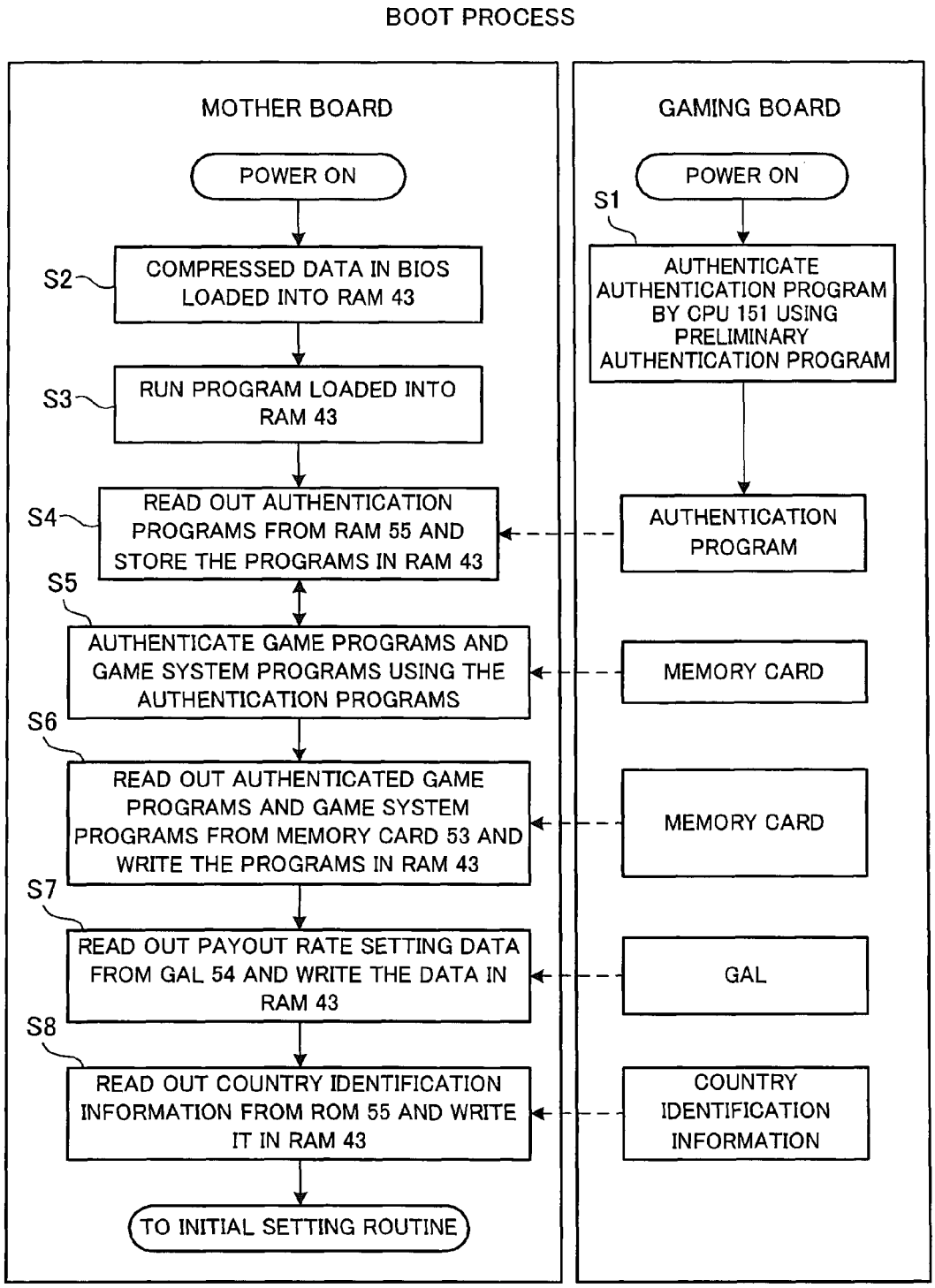
FIG. 13 is a flowchart illustrating a boot process executed by the gaming terminal and the center controller.
Figure 14:
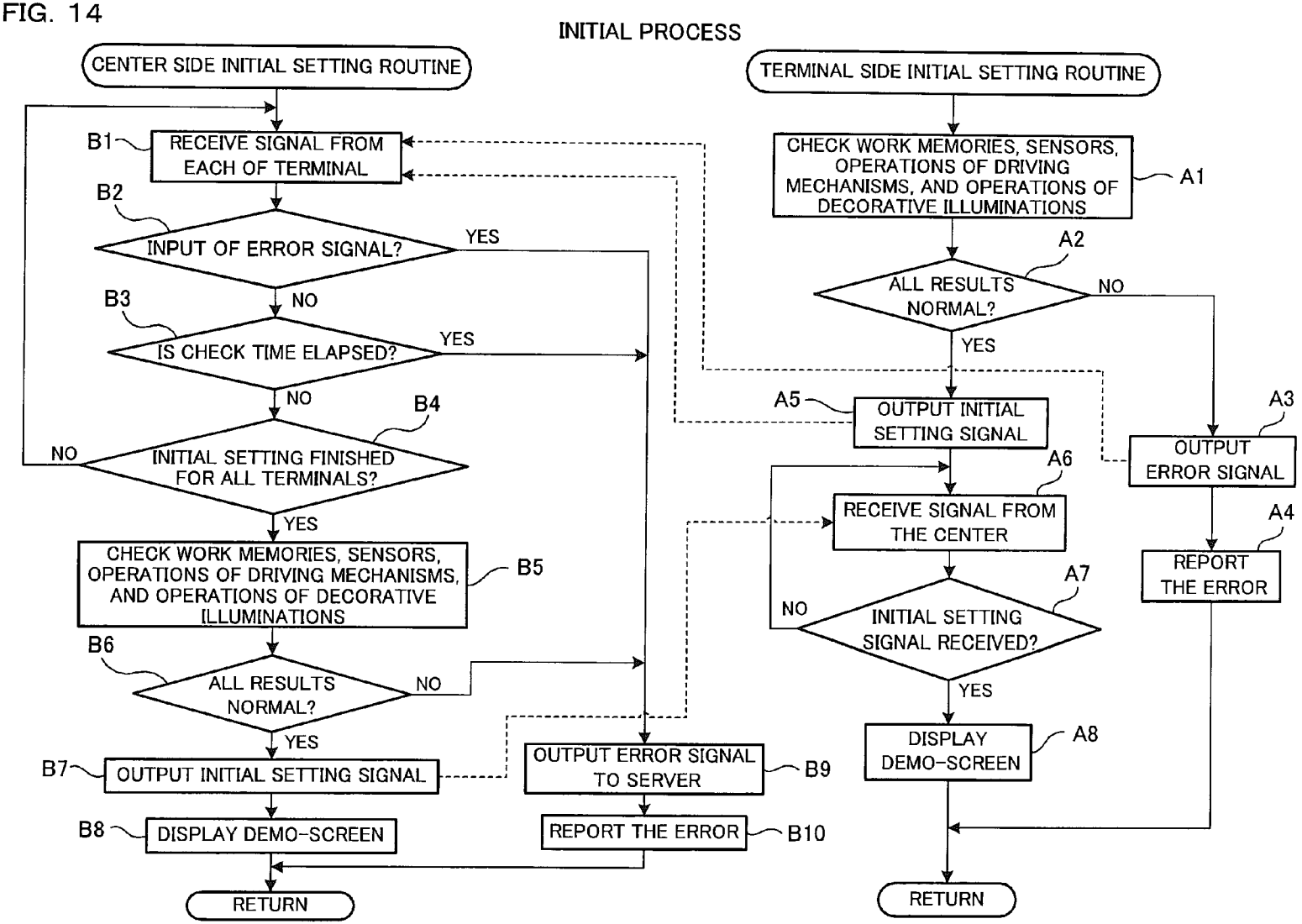
FIG. 14 is a flowchart illustrating an initial process executed by the gaming terminal and the center controller.

The following describes an initial process which takes place in the gaming machine 1. When the boot process of FIG. 13 is completed, the center controller 200 reads out from the RAM 243 a center side initial setting routine illustrated in FIG. 15 and executes the routine. Meanwhile, the gaming terminal 10 reads out from the RAM 43 a terminal side initial setting routine illustrated in FIG. 15 and executes the routine. The center side and terminal side initial setting routines are executed in parallel.

First, the main CPU 41 of each of the gaming terminals 10 checks operations of work memories such as the RAM 43, various sensors, various driving mechanisms, and various decorative illuminations (A1). Then, the main CPU 41 determines if all the check results are normal (A2). If the main CPU 41 determines that the check results contains an error (A2: NO), the main CPU 41 outputs a signal notifying the error (hereinafter, error signal) to the center controller 200 (A3). Further, the main CPU 41 reports the error in the form of illuminating the lamp 30 or the like (A4), and then ends the routine.

On the other hand in A2, if the main CPU 41 determines that all the check results are normal (A2: YES), an initial setting signal is output to the center controller 200 (A5). Then, an initial setting signal is waited from the center controller 200 (A6, A7: NO).

The main CPU 241 of the center controller 200 receives signals from each of the terminals (B1). Then, the main CPU 241 determines whether a signal received is an error signal (B2). If the main CPU 241 determines that the signal is an error signal (B2: YES), the main CPU 241 outputs the error signal to a server of a not-shown host computer or the like (B9) to report the error (B10), and ends the routine.

On the other hand in B2, if the main CPU 241 determines that the signal is not an error signal (B2: NO), the main CPU 241 determines whether a predetermined time (check time) has elapsed from the time of powering on (B3). If the main CPU 241 determines that the check time has elapsed (B3: YES), B9 is executed. On the other hand, if the main CPU 241 determines that the check time has not yet elapsed (B3: NO), it is determined whether an initial setting signal is received from each of the gaming terminals 10 (B4). If the main CPU 241 determines that an initial setting signal from any one of the gaming terminals 10 is not received (B4: NO), the process returns to B5. On the other hand, if it is determined that initial setting signals from all the gaming terminals 10 are received (B4: YES), the main CPU 241 checks operations of work memories such as RAM 243, various sensors, various driving mechanisms, and various decorative illuminations (B5). Then, the main CPU 241 determines whether all the check results are normal (B6). If the main CPU 241 determines the check results contain an error (B6: NO), the main CPU 241 executes B9.

On the other hand in B6, if the main CPU 241 determines that all the check results are normal (B6: YES), the main CPU 241 outputs an initial setting signal to all the gaming terminals 10 (B7), and causes the shared display 102 to display a demo-screen (B8). Then, the main CPU 241 ends the routine.

In A7, the main CPU 41 of each of the gaming terminals 10 determines that an initial setting signal is received from the center controller 200 (A7: YES), and causes the terminal display 101 to display a demo-screen (A7). The main CPU 41 then ends the routine.

(Operation of Gaming Terminal 10: Terminal Process Routine)

After the terminal side initial setting routine of FIG. 15, the main CPU 41 of the gaming terminal 10 performs a terminal process routine of FIG. 15. Through this terminal process routine, a game is run.

As illustrated in FIG. 15, in the terminal process routine, it is determined whether a coin is bet (C1). In this step, it is determined whether a signal from the 1-BET switch 26S entered by pressing of the 1-BET button 26 is received. Meanwhile, it is determined whether a signal from the maximum BET switch 27S entered by pressing of the maximum BET button 27 is received. If no coin is BET (C1: NO), C1 is repeated until a coin is bet.

On the other hand, if a coin is bet (C1: YES), the credit value stored in the RAM 43 is reduced according to the number of coins bet (C2). When the number of coins bet surpasses the number of coins equivalent to the credit value stored in the RAM 43, C2 is repeated without the reduction of the credit value. When the number of coins bet exceeds the maximum number of coins bettable one game (50 pieces in this embodiment), the process goes to a later-described step C3 without the reduction of the credit value.

Then, it is determined whether a spin button 23 is pressed (C3). If the spin button 23 is not pressed (C3: NO), the process returns to C1. Here, if the spin button 23 is not pressed (for example, the spin button 23 is not pressed but a command to end the game is input), the reduction of the credit value in C2 is canceled.

On the other hand, if the spin button 23 is pressed (C3: YES), a jackpot transmission process is executed (C4). In other words, a jackpot signal indicating a part of the game value bet is transmitted to the center controller 200.

Next executed is a symbol determining process (C5). That is, the stop symbol determining program stored in the RAM 43 is run to determine symbols to be arranged in the matrix 156. Through this, a symbol combination to be formed along the payline L is determined.

Then, the scrolling process is executed to scroll symbols on the terminal display 101 (C6). The scrolling process is a process in which the symbols determined in C5 are stopped (rearranged) in the matrix 156 after scrolling of symbols in a direction indicated by an arrow symbol.

Next, it is determined whether symbols rearranged in the matrix 156 form a winning combination (C7). If the symbols 180 form a winning combination (C7: YES), a payout process is executed (C8). More specifically, when a winning combination is formed, the number of coins according to the combination is calculated. On the other hand in C7, if it is determined that no winning combination is formed (C7: NO), C11 is executed.

After the execution of the payout process in C8, the main CPU 41 determines whether a bonus game is running and whether a predetermined winning is met (C9). If a bonus game start signal is received from the center controller 200, the main CPU 41 determines that the bonus game is running. If it is determined that the bonus game is running and a predetermined winning is met (C9: YES), a winning signal is output to the center controller 200 (C10) and the process of C11 is executed. On the other hand, if it is determined that the bonus game is not running or a predetermined winning is not met (C9: NO), the process of C11 is executed.

Next, the main CPU 41 determines whether a bonus award signal is received from the center controller 200 (C11). If the main CPU 41 determines that a bonus award signal is received (C11: YES), a payout is awarded according to the bonus award signal (C12). The process then returns to C1. On the other hand in C11, if the main CPU 41 determines that no bonus award signal is received (C11: NO), the process returns to C1.

(Operation of Center Controller 200: Center Process Routine)

Figure 16:
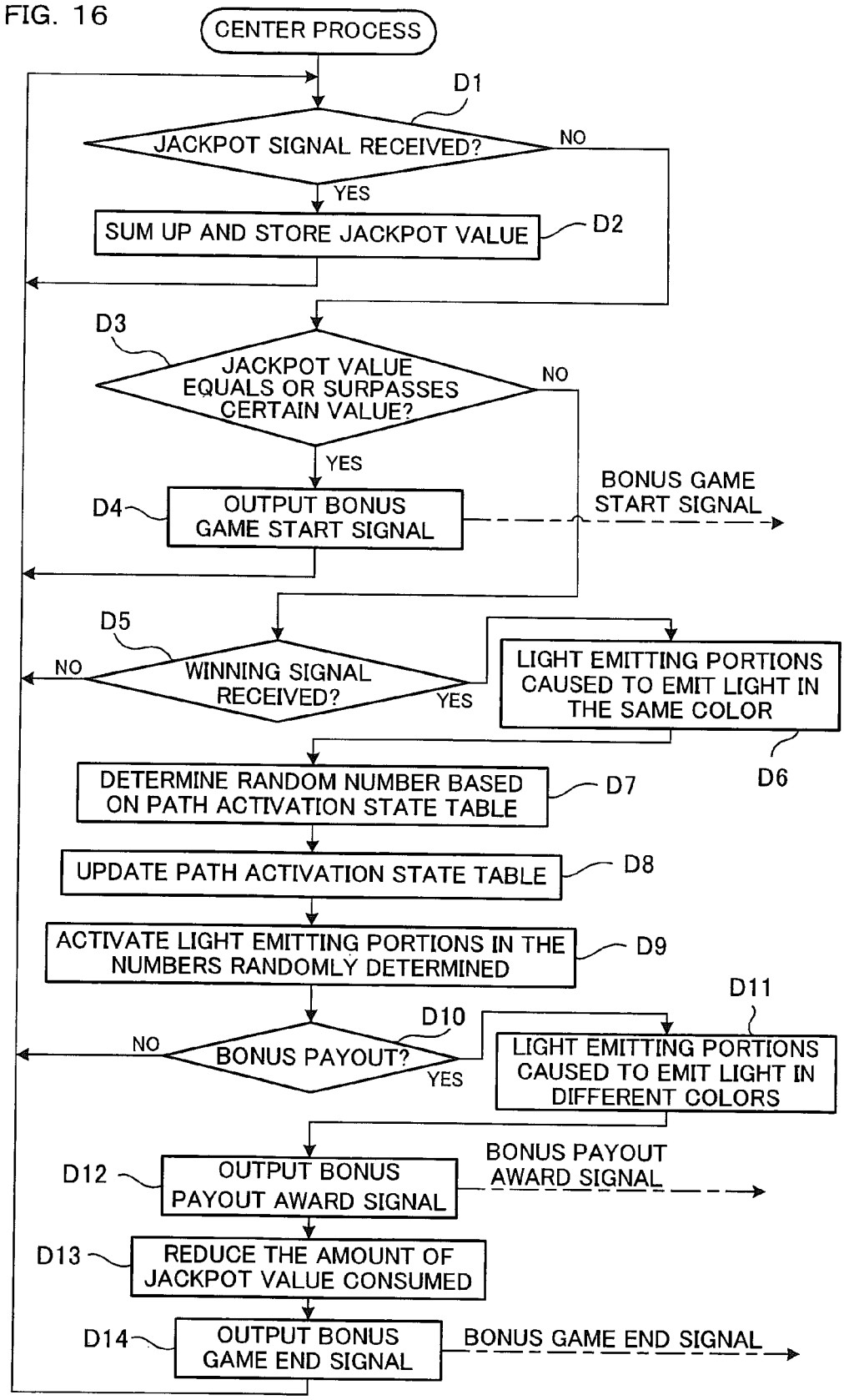
FIG. 16 is a flowchart illustrating a center process routine executed in the center controller.

After the center side initial setting routine of FIG. 15, the main CPU 241 of the center controller 200 executes a center process routine of FIG. 16. The main CPU 241 performs the center process routine to run a bonus game.

As illustrated in FIG. 16, in the center process routine, the main CPU 241 determines whether a jackpot signal is received from a gaming terminal 10 (D1). If it is determined that a jackpot signal is received (D1: YES), the game value indicated by the jackpot signal is stored cumulatively (D2). The process then returns to D1.

On the other hand in D1, if the main CPU 241 determines no jackpot signal is received (D1: NO), the main CPU 241 determines if the jackpot value equals or surpasses a predetermined value (D3). If it is determined that the jackpot value equals or surpasses a predetermined value (D3: YES), a bonus game start signal is output to each gaming terminal 10 (D4). Then, the process of D1 is executed.

If it is determined that the jackpot value does not equal or surpass a predetermined value (D3: NO), the main CPU 241 determines whether a winning signal is received from the terminal controller 100 (D5). If the main CPU 241 determines that a winning signal is not received (D5: NO), the process returns to D1. On the other hand, if it is determined that a winning signal is received (D5: YES), all of the light emitting portions 320 provided for the illuminating boards 310 in the illuminating device 300 (bonus payout indicator 300) are caused to emit light in the same color (D6). Then, the main CPU 241 determines a random number based on the path activation state table (D7). Then, the main CPU 241 updates the path activation state table based on the random number so determined (D8). The main CPU 241 then activates the light emitting portions 403 toward the bonus payout indicator 300, in numbers randomly determined as above (D9).

Then, it is determined whether a path 401 exists in which the light emitting portions 403 have been activated up to the bonus payout indicator 300, so as to determine whether conditions are met for awarding a bonus payout (D10). If it is determined that conditions for awarding a bonus payout are not met (D10: NO), the process returns to D1. On the other hand, if it is determined that conditions for awarding a bonus payout are met (D10: YES), the main CPU 241 causes the light emitting portions 320, provided for the illuminating boards 310 in the illuminating device 300 (bonus payout indicator 300), to emit light in different colors (D11). Then, a bonus award process is executed to award a bonus payout, and a bonus award signal is output to the gaming terminal 10 subject to the bonus payout (D12). Then, the amount of jackpot value consumed is reduced from the RAM 243 (D13), and a bonus game end signal is output to each gaming terminal 10 (D14). The process then returns to D1.

The illuminating device 300, with the structure described above, can be suitably used for a gaming machine 1 including: (I) an illuminating unit (bonus payout indicator 300, for example) that includes: an illuminating board 310 having a plate-like transparent board 312, a reflector 313 provided on a back surface of the transparent board 312 to reflect light, and a cloudy, translucent medium 311 provided on a front surface of the transparent board 312; a support member 330 supporting an end 310*a* of the illuminating board 310 in a cantilever fashion, so as to provide a free end for an end 310*b* of the illuminating board 310; a light emitting portion 320, arranged beside the end 310*a*, that emits light to the transparent board 312 at the end 310*a*; and an emission control unit that causes the light emitting portion 320 to emit light; (II) a plurality of control panels (gaming terminals 10, for example) that accepts a player's operation; and (III) a game controller (center controller 200, for example) programmed to perform the steps of: (a1) performing a multiplayer game; (a2) causing the control panels to accept a player's operation; (a3) changing a state of the game according to the operation accepted by the control panels; and (a4) causing the illuminating unit to emit light according to the state of the game.

The detailed description of the present invention provided hereinabove mainly focused on characteristics thereof for the purpose of easier understanding; however, the scope of the present invention shall be construed as broadly as possible, encompassing various forms of other possible embodiments, and therefore the present invention shall not be limited to the above description. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the invention described in the present specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer or computer network. The above descriptions and expressions are provided to allow the one skilled in the art to most efficiently understand the present invention. A process performed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes performed in the steps or blocks, these processes are essentially executed by various devices. Further, the other structures necessary for the steps or blocks are obvious from the above descriptions.

What is claimed is:

1. An illuminating device comprising:

a housing having a base, and peripheral walls provided along a rim of the base;

a set of illuminating boards forming a loop as viewed from front, the illuminating boards each having a plate-like transparent board, a reflector provided on a back surface of the transparent board to reflect light, and a cloudy, translucent medium provided on a front surface of the transparent board;

a support member supporting an end of each illuminating board in a cantilever fashion, so as to provide a free end for the other end of the illuminating board, the illuminating boards being adjacent to the peripheral walls as viewed from the front;

a light emitting portion, arranged beside the supported end of each illuminating board, that emits light to the transparent board at the supported end; and an emission control unit that causes the light emitting portion to emit light.

2. The illuminating device according to claim 1, wherein the light emitting portion is capable of emitting light in multiple colors.

3. An illuminating device comprising:

a housing having a base, and peripheral walls provided along a rim of the base;

plural sets of illuminating boards forming a loop as viewed from front, the illuminating boards each having a plate-like transparent board, a reflector provided on a back surface of the transparent board to reflect light, and a cloudy, translucent medium provided on a front surface of the transparent board;

a support member, provided for each illuminating board, supporting an end of the illuminating board in a cantilever fashion, so as to provide a free end for the other end of the illuminating board;

a light emitting portion, arranged beside the supported end of each illuminating board, that emits light to the transparent board at the supported end; and an emission control unit that causes the light emitting portion to emit light, wherein the peripheral walls and the sets of illuminating boards are arranged adjacent to one another in this order as viewed from the front, and wherein the sets of illuminating boards are arranged at different distances from the base.

4. The illuminating device according to claim 3, wherein the light emitting portion is capable of emitting light in multiple colors, and wherein the emission control unit causes the light emitting portions to emit light in different colors.

5. A gaming machine comprising:

an illuminating unit that includes an illuminating board having a plate-like transparent board, a reflector provided on a back surface of the transparent board to reflect light, and a cloudy, translucent medium provided on a front surface of the transparent board, a support member supporting an end of the illuminating board in a cantilever fashion, so as to provide a free end for the other end of the illuminating board, a light emitting portion, arranged beside the supported end of the illuminating board, that emits light to the transparent board at the supported end, and an emission control unit that causes the light emitting portion to emit light;

a plurality of control panels that accepts a player's operation; and a game controller programmed to perform the steps of:

(a1) performing a multiplayer game;

(a2) causing the control panels to accept a player's operation;

(a3) changing a state of the game according to the operation accepted by the control panels; and (a4) causing the illuminating unit to emit light according to the state of the game.

* * * * *